US006177919B1

(12) United States Patent
Numao

(10) Patent No.: US 6,177,919 B1
(45) Date of Patent: Jan. 23, 2001

(54) PASSIVE-MATRIX TYPE LIQUID CRYSTAL DISPLAY APPARATUS AND DRIVE CIRCUIT THEREOF WITH SINGLE ANALOG SWITCH/ADJUSTED SCANNING VOLTAGE BASED OPERATION

(75) Inventor: Takaji Numao, Kashiwa (JP)

(73) Assignees: Sharp Kabushiki Kaisha, Osaka (JP); The Secretary of State for Defence in Her Britannic Majesty's Government of the United Kingdom of Great Britain and Northern Ireland, Hants (GB)

( * ) Notice: Under 35 U.S.C. 154(b), the term of this patent shall be extended for 0 days.

(21) Appl. No.: 08/810,549

(22) Filed: Mar. 4, 1997

(30) Foreign Application Priority Data

Jun. 7, 1996 (JP) ..... 8-146236

(51) Int. Cl.[7] ..... G09G 3/36
(52) U.S. Cl. ..... 345/94; 345/97
(58) Field of Search ..... 345/89, 95, 94, 345/96, 97, 100, 101, 210, 147, 208; 349/149, 169, 179

(56) References Cited

U.S. PATENT DOCUMENTS

| | | | | |
|---|---|---|---|---|
| 4,516,836 | * | 5/1985 | Ferrato | 349/149 |
| 4,776,676 | * | 10/1988 | Inoue et al. | 345/89 |
| 5,013,137 | * | 5/1991 | Tsuboyama et al. | 345/97 |
| 5,471,229 | * | 11/1995 | Okada et al. | 345/89 |
| 5,576,729 | * | 11/1996 | Yamazaki | 345/94 |
| 5,602,562 | * | 2/1997 | Onitsuka et al. | 345/101 |
| 5,748,277 | * | 5/1998 | Huang et al. | 345/95 |
| 5,825,346 | * | 10/1998 | Fujita | 345/97 |
| 5,828,357 | * | 10/1998 | Tamai et al. | 345/89 |
| 5,861,869 | * | 1/1999 | Scheffer et al. | 345/89 |

FOREIGN PATENT DOCUMENTS

| | | | |
|---|---|---|---|
| 0478371 | | 4/1992 | (EP) . |
| 0685832 | | 12/1995 | (EP) . |
| 0691639 | | 1/1996 | (EP) . |
| 2177841 | | 1/1987 | (GB) . |
| 0188928 | * | 9/1985 | (JP) ..... 345/101 |
| 5100635 | | 4/1993 | (JP) . |
| 06018848 | | 1/1994 | (JP) . |
| 07120722 | | 5/1995 | (JP) . |
| 08050278 | | 2/1996 | (JP) . |
| 8901681 | | 2/1989 | (WO) . |
| 8905025 | | 6/1989 | (WO) . |
| 9418665 | | 8/1994 | (WO) . |
| 9524715 | | 9/1995 | (WO) . |

OTHER PUBLICATIONS

P.W.H. Surguy et al; Ferroelectrics, 1991, vol. 122, pp. 63–79; "The "Joers/Alvey" Ferroelectric Multiplexing Scheme".

* cited by examiner

*Primary Examiner*—Chanh Nguyen
(74) *Attorney, Agent, or Firm*—Renner, Otto, Boiselle & Sklar LLP

(57) ABSTRACT

A segmented electrode drive circuit of a passive-matrix type liquid crystal display apparatus includes one analog switch in each of segmented electrodes, supplies "0" as a control signal in the first slot of a three-slot selecting period so as to make the electrical potential of a segmented electrode zero. "1" is supplied as a control signal in the second slot so as to bring the output terminal of an analog switch selected by the data signal into a high-impedance state. As a result, the electric potential of the segmented electrode in the high-impedance state becomes an average electric potential of scanning electrodes capacitive-coupled with the segmented electrode.

2 Claims, 23 Drawing Sheets

PASSIVE-MATRIX TYPE LIQUID CRYSTAL DISPLAY APPARATUS AND DRIVE CIRCUIT THEREOF WITH SINGLE ANALOG SWITCH/ADJUSTED SCANNING VOLTAGE BASED OPERATION

FIELD OF THE INVENTION

The present invention relates to a passive-matrix type liquid crystal display apparatus, and more particularly relates to a passive-matrix type liquid crystal display apparatus using ferroelectric liquid crystals and a drive circuit thereof.

BACKGROUND OF THE INVENTION

FIG. 20 shows the structure of a drive circuit of a passive-matrix type liquid crystal display apparatus disclosed in Japanese Publication for Unexamined Patent Application (Tokukaihei) No. 6-18848 (1994). In this structure, two analog switches are provided for each segmented electrode Yi (i=1 to m). For instance, when an analog switch 261 connected to a segmented electrode $Y_1$ is turned ON, a voltage $V_3$ is applied to the segmented electrode Yi. In other cases, an analog switch 241 is turned ON, and a voltage $V_1$ is applied to the segmented electrode Yi.

FIG. 21 shows a drive circuit on the source side of an active-matrix type liquid crystal display apparatus disclosed in Japanese Publication for Unexamined Patent Application (Tokukaihei) No. 5-100635 (1993). In this drive circuit structure, a voltage to be applied to the active-matrix type liquid crystal display apparatus is determined by selecting a power source from external power sources V0 to V7 according to the values of high order bits D1 to D3 of data retained in a latch circuit 201, and by turning ON/OFF an analog switch 206 according to the values of low order bits D4 and D5 and a timing control signal 209.

FIGS. 22 and 19 are block diagrams showing examples of the structure of a drive circuit of a conventional ferroelectric liquid crystal display apparatus and the waveforms of drive voltages. A drive circuit 71 on the scanning side, for driving scanning electrodes L, includes a shift register 76 and an analog switch array 77. The drive circuit 71 selects one voltage waveform from three voltage waveforms, $V_{CA}$, $V_{CB}$ and $V_{CC}$, shown in FIG. 19, based on the value of input two-bit data YI, and applies the selected waveform to the scanning electrodes.

A drive circuit 72 on the segment side, for driving segmented electrodes S, includes a shift register 73, a latch 74, and an analog switch array 75. The drive circuit 72 selects one voltage waveform from two voltage waveforms, $V_{SD}$ and $V_{SE}$, shown in FIG. 19, based on data XI retained in the latch 74, and applies the selected waveform to the segmented electrodes.

FIG. 23 shows an example of the waveforms used by a drive scheme for a ferroelectric liquid crystal display apparatus, which was suggested by the present inventors and disclosed in Japanese Publication for Unexamined Patent Application (Tokukaihei) No. 8-50278 (1996). In this drive scheme, a multiple gray scale display is achieved with a ferroelectric liquid crystal display apparatus by forming one pixel from three sub-pixels $A_{ijA}$, $A_{ijB}$ and $A_{ijC}$ which are driven by three lines of scanning electrodes $L_{iA}$, $L_{iB}$ and $L_{iC}$ (i=0, 1, . . . ), and one line of segmented electrode $S_j$ (j=0, 1, . . . ) as shown in FIG. 11, and by applying different selection voltage waveforms $V_{CA}$, $V_{CB}$ and $V_{CC}$ shown in FIG. 23, to the three lines of scanning electrodes, respectively.

However, the above-mentioned conventional structure suffers from the following drawbacks.

In the drive circuit on the segment side of the conventional passive-matrix type liquid crystal display apparatus, two analog switches are required for one output level of each output terminal. When forming the drive circuit as an integrated circuit, if the number of output terminals and the area of a chip are fixed, the area for each analog switch can be increased by decreasing the number of analog switches per output terminal, and the output resistance of each output terminal can be reduced by an amount corresponding to the increase.

The technique disclosed in Japanese Publication for Unexamined Patent Application (Tokukaihei) No. 5-100635 (1993) above is a technique for decreasing the number of analog switches per output terminal in the drive circuit on the source side of the active-matrix type liquid crystal display apparatus. However, a scheme to obtain a plurality of output levels using one analog switch as a drive circuit of a passive-matrix type liquid crystal display apparatus has not yet been proposed.

A conventional ferroelectric liquid crystal display apparatus achieves bright and dark displays by using bistability of ferroelectric liquid crystals and aligning the molecule long axis of a ferroelectric liquid crystal molecule in one of the stable states with the polarization axis of a polarizing plate. With the use of ferroelectric liquid crystals with negative dielectric anisotropy, the memory angle changes depending on the root-mean-square value of a bias voltage applied, and the memory angle becomes larger with an increase in the root-mean-square value.

For example, in the drive scheme disclosed in Japanese Publication for Unexamined Patent Application (Tokukaihei) No. 8-50278 (1996) above, four kinds of voltage waveforms are applied to the segmented electrodes, and a variation of the root-mean-square value of the bias voltage is relatively wide. Therefore, even when the polarizing plate is positioned according to one bias state, if the display pattern changes into another bias state, the memory angle changes and the contrast is lowered.

The memory angle of the ferroelectric liquid crystal also changes depending on temperature. Therefore, even when the polarization axis of the polarizing plate is positioned according to a memory angle at a certain temperature, the memory angle varies as the temperature changes, and the contrast is lowered.

SUMMARY OF THE INVENTION

The first object of the present invention is to provide a segment drive circuit of a passive-matrix type liquid crystal display apparatus, capable of giving a plurality of output levels using one analog switch.

The second object of the present invention is to reduce the variation of the root-mean-square value of bias voltage and to prevent a lowering of the contrast in a ferroelectric liquid crystal display apparatus providing a multiple gray scale display using more than one kind of voltage waveforms.

The third object of the present invention is to compensate for a change in the memory angle of ferroelectric liquid crystals caused by a change in temperature, and to prevent a lowering of the contrast.

In order to achieve the first object, a passive-matrix type liquid crystal display apparatus of the present invention includes a pixel formed by a liquid crystal lying at each intersection of scanning electrodes and segmented electrodes, and is constructed so that a single analog switch is connected to each segmented electrode, a first electric potential is generated in the segmented electrode through the single analog switch connected thereto, by bringing the single analog switch into a conductive state and injecting a predetermined electric charge into the segmented electrode, and an electric potential different from the first electric potential is generated in the segmented electrode by bringing the single analog switch into a non-conductive state and adjusting a voltage to be applied to the scanning electrode.

In this structure, first, the analog switch is brought into a conductive state and a predetermined electric charge is injected into the segmented electrode so as to cause the segmented electrode to have the first electric potential corresponding to the predetermined electric charge. Next, when the analog switch is brought into a non-conductive state, since the electric charge does not enter into nor leave from the segmented electrode connected to this analog switch, the predetermined electric charge is retained on the segmented electrode.

The predetermined electric charge, Q, is given by $$Q=CV$$

where C is the capacity of liquid crystal located between the scanning electrode and the segmented electrode, and V is the potential difference between the scanning electrode and the segmented electrode. Since Q and C are constant, when the voltage to be applied to the scanning electrode is changed, the electric potential of the segmented electrode varies according to the change. Namely, it is possible to produce an electric potential different from the first electric potential in the segmented electrode by adjusting the voltage to be applied to the scanning electrode.

Consequently, in the structure where the number of analog switches connected to the segmented electrode is arranged to be one, more than one kind of electric potentials can be produced in the segmented electrode, thereby simplifying the structure of the drive circuit on the segmented electrode side. For example, when forming the drive circuit by an IC, if the area of a silicon wafer and the number of output terminals per IC are fixed, the area of each analog switch can be increased and the output impedance can be lowered as compared to the structure requiring a plurality of analog switches for each output terminal. On the other hand, if a lowering of the output impedance is not required, it is possible to reduce the area of the silicon wafer per IC on condition that the number of output terminals is fixed. It is therefore possible to produce a drive circuit of a passive-matrix type liquid crystal display apparatus at reduced costs.

Moreover, in the passive-matrix type liquid crystal display apparatus, the liquid crystals are preferably ferroelectric liquid crystals. Since the ferroelectric liquid crystals have memory effects, and a higher response speed than that of nematic liquid crystals, it is possible to provide a passive-matrix type liquid crystal display apparatus capable of achieving a large-capacity display.

The liquid crystals are more preferably ferroelectric liquid crystals with negative dielectric anisotropy.

In order to achieve the second object, another passive-matrix type liquid crystal display apparatus of the present invention includes a pixel formed by a liquid crystal lying at each intersection of scanning electrodes and segmented electrodes, and is constructed so that the liquid crystal is a ferroelectric liquid crystal and a voltage is applied to the scanning electrode in a non-selecting period, the voltage having a waveform formed by a bipolar pulse with a pulse height $V_a$ and a bipolar pulse with a pulse height $V_b$, $V_a$ and $V_b$ satisfying $$V_a<(V_{max}+V_{min})/2<V_b$$

where $V_{max}$ is a maximum of pulse heights of voltages to be applied to the segmented electrode and $V_{min}$ is a minimum thereof.

In this structure, by applying a bipolar pulse having pulse heights $V_a$ and $V_b$ satisfying $$V_a<(V_{max}+V_{min})/2<V_b$$

to the scanning electrode in the non-selecting period, the root-mean-square value of the bias voltage is equalized as compared to the conventional structure disclosed by, for example, Japanese Publication for Unexamined Patent Application (Tokukaihei) No. 8-50278 (1996), where a bipolar pulse represented by $V_c=(V_{max}+V_{min})/2$ is applied to the scanning electrode.

More specifically, when the voltage waveforms to be applied to the segmented electrode has more than two pulse heights, the root-mean-square value of the bias voltage is equalized by periodically applying a waveform with a pulse height which is close to the minimum of the above-mentioned pulse heights and a waveform with a pulse height which is close to the maximum thereof rather than taking the average of these pulse heights as the pulse height of a non-selection voltage.

The memory angle of the ferroelectric liquid crystals varies depending on the root-mean-square value of the bias voltage applied. It is possible to reduce the change of the memory angle and improve the contrast by equalizing the root-mean-square value of the bias voltage in the manner mentioned above.

In order to achieve the second object, still another passive-matrix type liquid crystal display apparatus includes a pixel formed by a liquid crystal lying at each intersection of scanning electrodes and segmented electrodes, and is constructed so that the liquid crystal is a ferroelectric liquid crystal and a voltage is applied to the scanning electrodes in a non-selecting period, the voltage having a waveform formed by a first unipolar pulse of two slots having a pulse height $V_x$ and a second unipolar pulse with the pulse height $V_x$ and a polarity opposite to that of the first unipolar pulse, $V_x$ being either $V_a$ or $V_b$ satisfying $$V_a<(V_{max}+V_{min})/2<V_b$$

where $V_{max}$ is a maximum of a pulse heights of voltages to be applied to the segmented electrodes and $V_{min}$ is a minimum thereof.

In this structure, the root-mean-square value of the bias voltage can be equalized as compared to the conventional structure where a bipolar pulse represented by $V_c=(V_{max}+V_{min})/2$ is applied to the scanning electrode in the non-selecting period. As a result, the change of the memory angle of the ferroelectric liquid crystal is reduced, and the contrast is improved.

In order to achieve the third object, yet another passive-matrix type liquid crystal display apparatus of the present invention includes a pixel formed by a liquid crystal lying at each intersection of scanning electrodes and segmented electrodes, and is constructed so that the liquid crystal is a ferroelectric liquid crystal, a DC voltage varying according to a measured change in temperature of the liquid crystal is superimposed over a drive voltage applied to the scanning electrodes.

With the use of the bistable states, the ferroelectric liquid crystal is constructed so as to achieve a bright state by aligning the long axis of the liquid crystal molecule in one of bistable state with the polarization axis of the polarizing plate to transmit light and a dark state when the liquid crystal molecule enters into the other of bistable state. However, in the ferroelectric liquid crystal, since the memory angle varies with a change in temperature, even if the long axis of the liquid crystal molecule in one of the stable states is aligned with the polarization axis at certain a temperature, the long axis of the molecule and the polarization axis become out of alignment with a change in temperature, resulting in a lowering of the contrast.

In this structure, the change of the memory angle caused by a temperature change can be compensated by measuring a change in the temperature of the ferroelectric liquid crystal and superimposing a DC current having a voltage corresponding to the temperature change on the drive voltage to be applied to the scanning electrode. Such a compensation is achieved because when a weak DC voltage is kept applied to the ferroelectric liquid crystal molecule in the stable state, the liquid crystal molecule moves in a direction at an angle corresponding to the value of the DC voltage without causing a switching. Therefore, even when the temperature of the ferroelectric liquid crystal varies due to a variation of ambient temperature and heat generated by the liquid crystal display apparatus, it is possible to prevent a lowering of the contrast.

Further, in the above-mentioned structure, it is preferred that the blanking voltage is applied to the scanning electrode before the selecting period, a voltage for cancelling the superimposed DC component is applied to the scanning electrode after the blanking voltage and before the selecting period.

In this arrangement, since the superimposed DC component is canceled to achieve a DC balance, it is possible to stabilize the drive characteristics of ferroelectric liquid crystal. In particular, when the ferroelectric liquid crystal has negative dielectric anisotropy, the response speed becomes fastest at a voltage $V_{min}$, and a switching is not effected even if a voltage greater than the voltage $V_{min}$ is applied. If a voltage greater than the voltage $V_{min}$ is applied after the blanking voltage and before the selecting period, it is possible to achieve a DC balance without affecting a switching operation, and to prevent a lowering of the contrast.

Furthermore, in order to achieve the above-mentioned first object, a drive circuit of a passive-matrix type liquid crystal display apparatus of the present invention is a drive circuit for a passive-matrix type liquid crystal display apparatus having a pixel formed by a liquid crystal lying at each intersection of scanning electrodes and segmented electrodes, and is constructed so that each output terminal connected to the segmented electrode is formed by a single analog switch. In this structure, since the structure of the drive circuit on the segmented electrode side is simplified, it is possible to achieve a compact drive circuit capable of being produced at reduced costs.

For a fuller understanding of the nature and advantages of the invention, reference should be made to the ensuing detailed description taken in conjunction with the accompanying drawings.

DESCRIPTION OF THE PREFERRED EMBODIMENTS

Embodiment 1

The following description will discuss one embodiment of the present invention with reference to FIGS. 1 to 10.

First, the structure of a liquid crystal panel 1 of a ferroelectric liquid crystal display apparatus (passive-matrix type liquid crystal display apparatus) of this embodiment will be explained.

Figure 2:
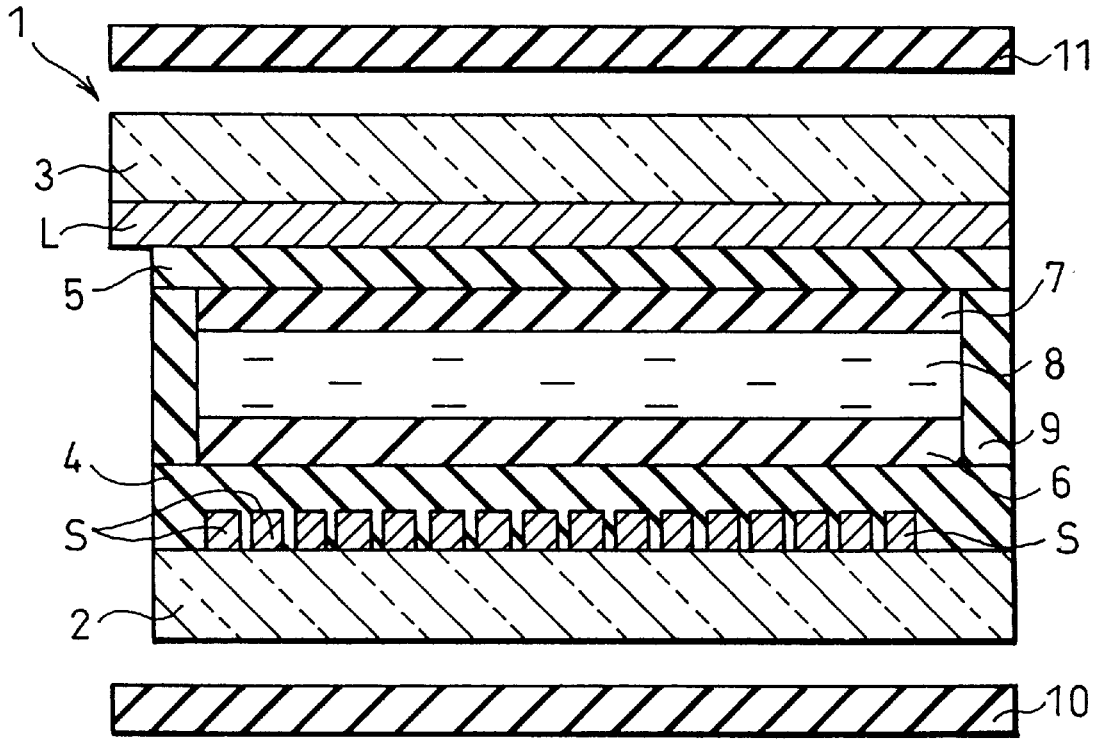
FIG. 2 is a cross sectional view showing the structure of a liquid crystal panel in the ferroelectric liquid crystal display apparatus.

As illustrated in FIG. 2, the liquid crystal panel 1 includes two pieces of substrates 2 and 3 positioned to face each other. The substrates 2 and 3 are formed by light transmitting material such as glass. On a surface of the substrate 2, a plurality of transparent segmented electrodes S made of, for example, indium tin oxide (hereinafter referred to as "ITO") are arranged parallel to each other. These segmented electrodes S are covered with a transparent insulating film 4 made of, for example, silicone oxide ($SiO_2$).

On the other hand, on the surface of the substrate 3, transparent scanning electrodes L made of, for example, ITO are arranged parallel to each other in a direction orthogonal to the segmented electrodes S. These scanning electrodes L are also covered with an insulating film 5 made of the same material as that of the insulating film 4.

Alignment films 6 and 7 to which a uniaxial aligning treatment such as rubbing treatment has been applied are placed on the insulating films 4 and 5, respectively. As the alignment films 6 and 7, for example, polyvinyl alcohol is used.

The substrates 2 and 3 are fastened with a sealing agent 9 so that the alignment films 6 and 7 face each other, and the space between the substrates 2 and 3 is filled with ferroelectric liquid crystals (hereinafter referred to as the "FLC") 8 to form a liquid crystal layer. The FLC 8 is injected through an inlet (not shown) provided in the sealing agent 9 and sealed in the space between the alignment films 6 and 7 by, for example, vacuum injection. After injecting the FLC 8, the inlet is closed with the sealing agent 9.

The substrates 2 and 3 are sandwiched between two pieces of polarizing plates 10 and 11 which are positioned so that the polarization axes thereof cross each other at right angles. The space between the scanning electrodes L and the segmented electrodes S are arranged to be about 1.5 $\mu$m. By narrowing the cell gap to such a degree, the molecules of the FLC 8 show bistability.

The FLC 8 can be prepared by mixing a ferroelectric liquid crystal material (product name: SCE-8) produced by Merck Ltd. with a compound represented by the following general formula (Formula 1) in a ratio of 9 to 1. The dielectric anisotropy of the ferroelectric liquid crystal material is negative. The alignment films 6 and 7 are achieved by, for example, PSI-A-2101 (product name) available from Chisso Co., Ltd.

Formula 1

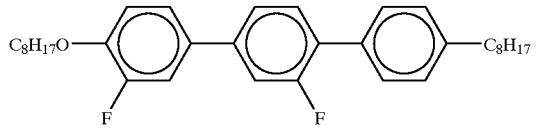

Figure 3A:
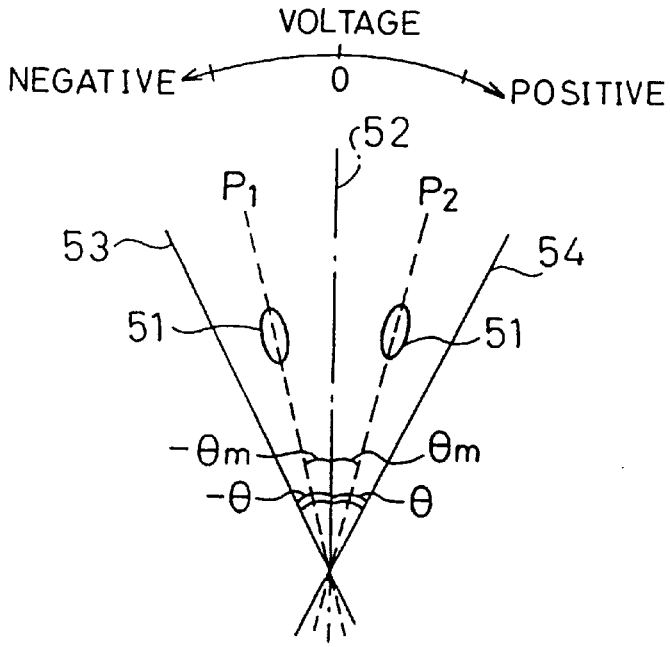
FIG. 3(*a*) is an explanatory view showing how the ferroelectric liquid crystal molecule sealed in the liquid crystal panel is switched between bistable states, and FIG. 3(*b*) is a perspective view showing the state of the ferroelectric liquid crystal molecule in a smectic C phase.
Figure 3B:
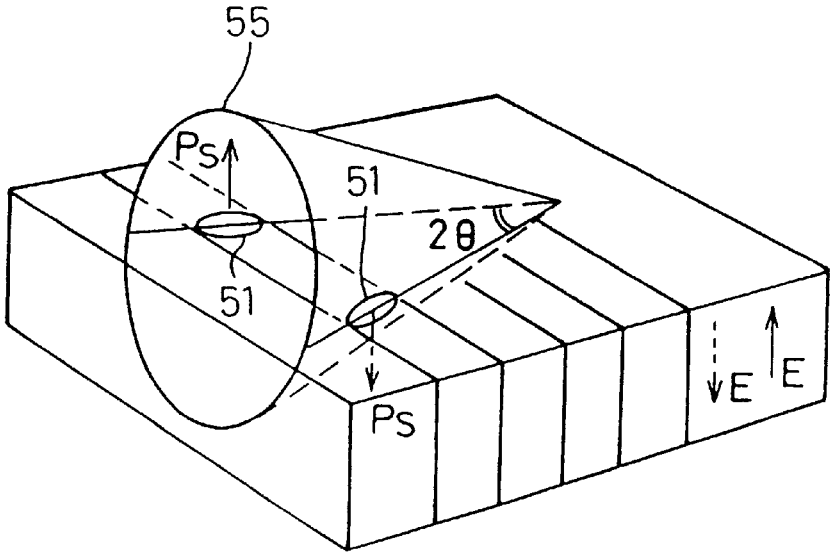

As illustrated in FIG. 3(*b*), a liquid crystal molecule 51 of the FLC 8 has a spontaneous polarization $P_S$ in a direction perpendicular to the molecular long axis direction. The liquid crystal molecule 51 receives a force proportional to the vector product of the spontaneous polarization $P_S$ and an electric field E produced by a potential difference between a voltage applied to the scanning electrode L and a voltage applied to the segmented electrode S, and moves on the surface of a conical locus 55. As shown in FIG. 3(*a*), the liquid crystal molecule 51 is brought into a stable state at position $P_1$ by an electric field E, and is brought into a stable state at position $P_2$ by the electric field E inverted.

Therefore, by aligning one of the polarization axes of the polarizing plates 10 and 11 with the long axis of the liquid crystal molecule 51 at either position $P_1$ or $P_2$, it is possible to achieve two display states, bright and dark states. More specifically, a pixel having the liquid crystal molecule 51 in one of the stable states exhibits a bright display state, while a pixel having the liquid crystal molecule 51 in the other stable state shows a dark display state.

A force proportional to the product of the square of the electric field E and the dielectric anisotropy $\Delta\epsilon$ as the difference in the dielectric constant between the directions of the molecular long axis and the molecular short axis is exerted on the liquid crystal molecule 51 as well as the force of the above-mentioned electric field E. Therefore, the force, F, exerted on the liquid crystal molecule 51 is given by the following equation.

$$F=K_0\times P_S\times E+K_1\times\Delta\epsilon\times E^2$$

where $K_0$ and $K_1$ are constants.

Therefore, in the ferroelectric liquid crystal whose dielectric anisotropy $\Delta\epsilon$ is negative, when the electric field E increases, an increase in the force produced by the effect of the negative dielectric anisotropy $\Delta\epsilon$ becomes greater than an increase in the force produced by the spontaneous polarization $P_S$ in an electric field $E_{min}$, and the force exerted on the liquid crystal molecule 51 is maximized in the electric field $E_{min}$. Moreover, since it is considered that the memory pulse width is in inverse proportion to the force exerted on the liquid crystal molecule 51, the memory pulse width is minimized in the electric field $E_{min}$. Consequently, the ferroelectric liquid crystal with negative dielectric anisotropy $\Delta\epsilon$ has a minimum memory pulse width $\tau_{min}$ against a specific voltage $V_{min}$, i.e., showing a so called $\tau$–$V_{min}$ characteristic.

Here, the JOERS/Alvey drive scheme (hereinafter referred to as the "J/A drive scheme") presented as "The JOERS/Alvey Ferroelectric Multiplexing Scheme" by the Defense Research Agency in the FLC International Conference (1991) will be explained as an example of conventional drive schemes using the $\tau$–$V_{min}$ characteristic for reference.

Figure 19:
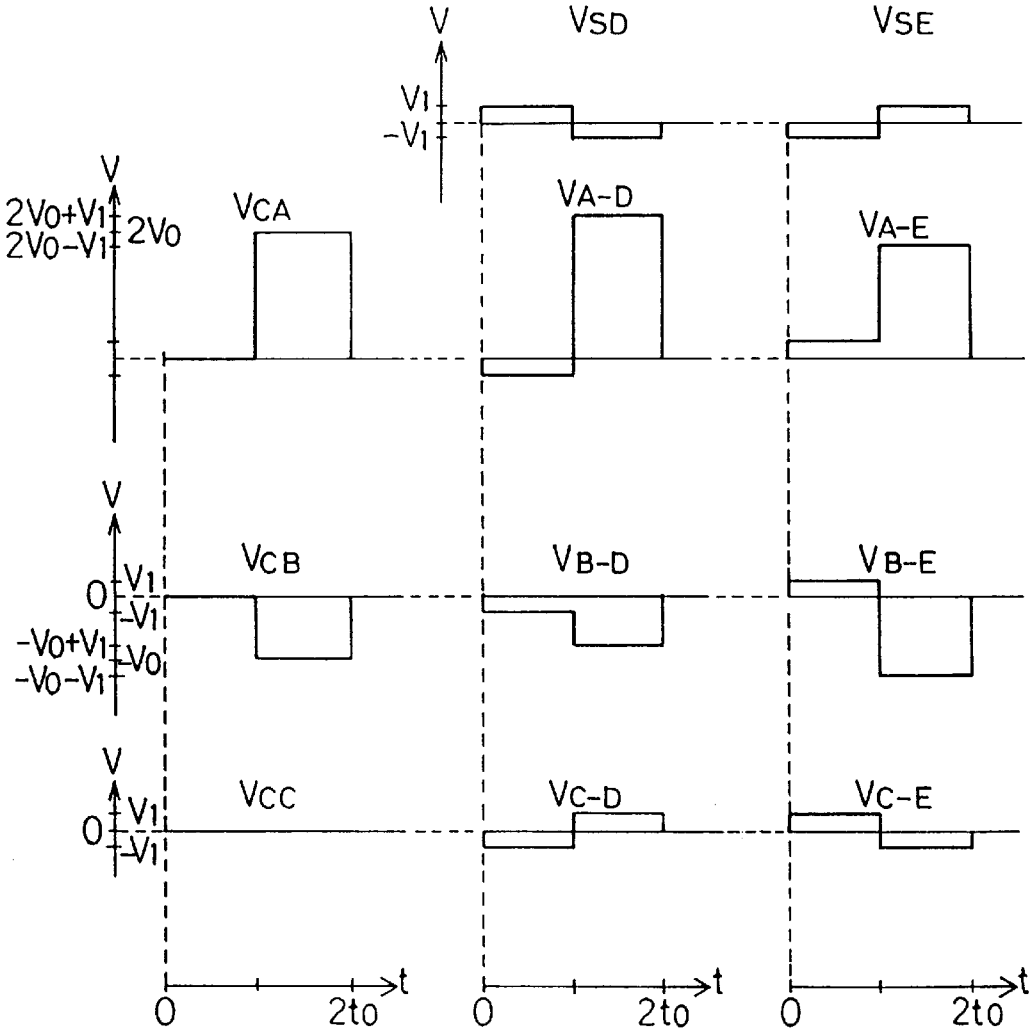
FIG.19 PRIOR ART
FIG. 19 is a waveform illustration showing the waveforms of drive voltages according to the JOERS/Alvey drive scheme.
Figure 20:
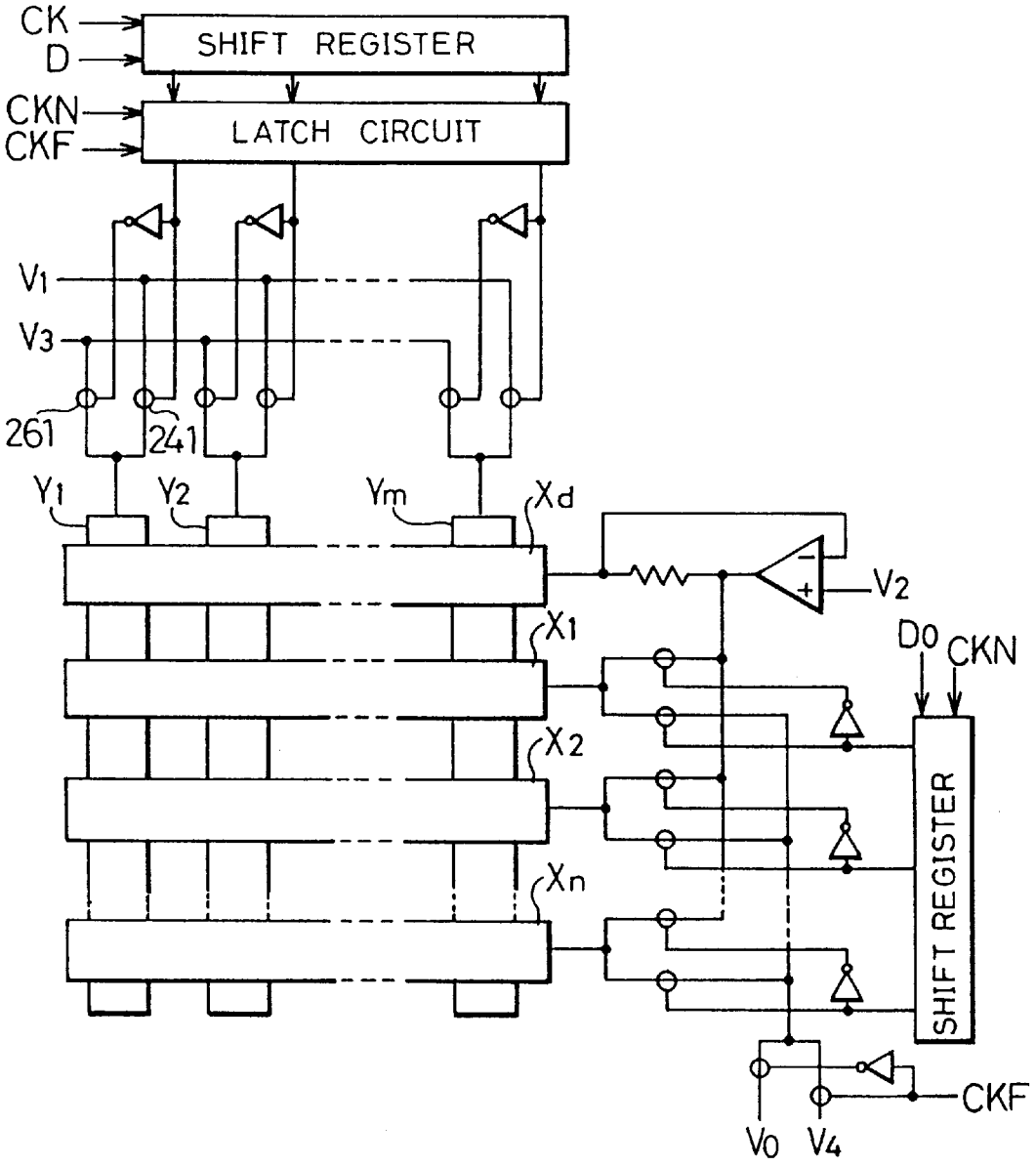
FIG. 20 PRIOR ART
FIG. 20 is a block diagram showing an example of a drive circuit of a conventional passive-matrix type liquid crystal display apparatus.
Figure 21:
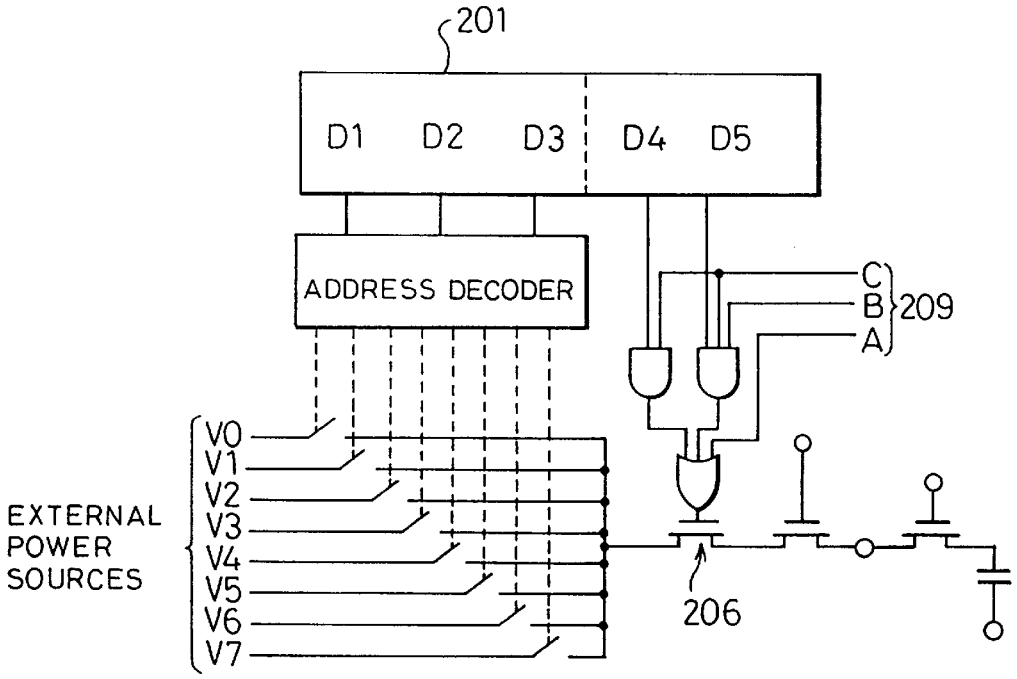
FIG. 21 PRIOR ART
FIG. 21 is a block diagram showing an example of a drive circuit of a conventional active-matrix type liquid crystal display apparatus.
Figure 22:
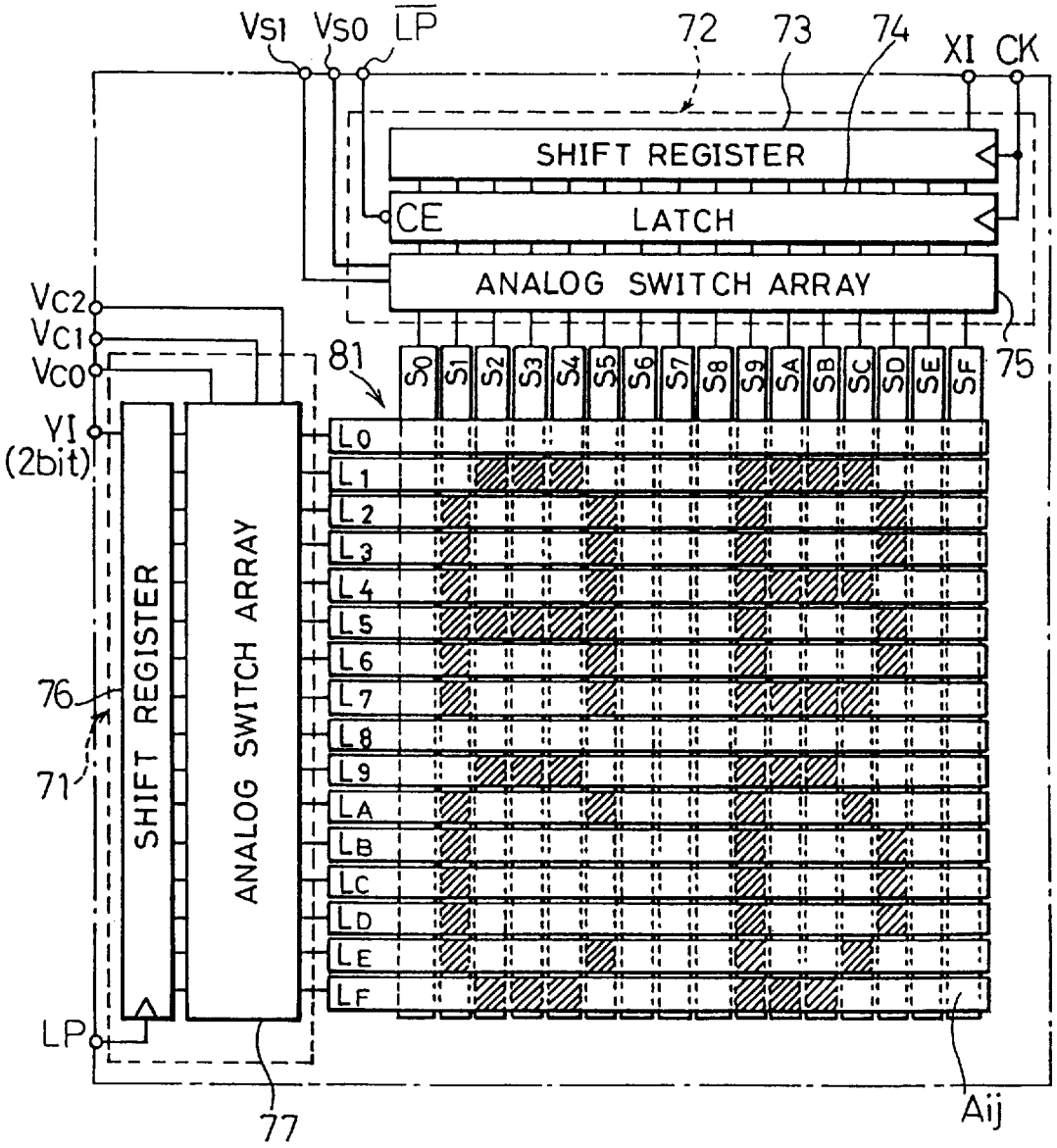
FIG. 22 PRIOR ART
FIG. 22 is a block diagram showing an example of the structure of a drive system of a conventional ferroelectric liquid crystal display apparatus.
Figure 23:
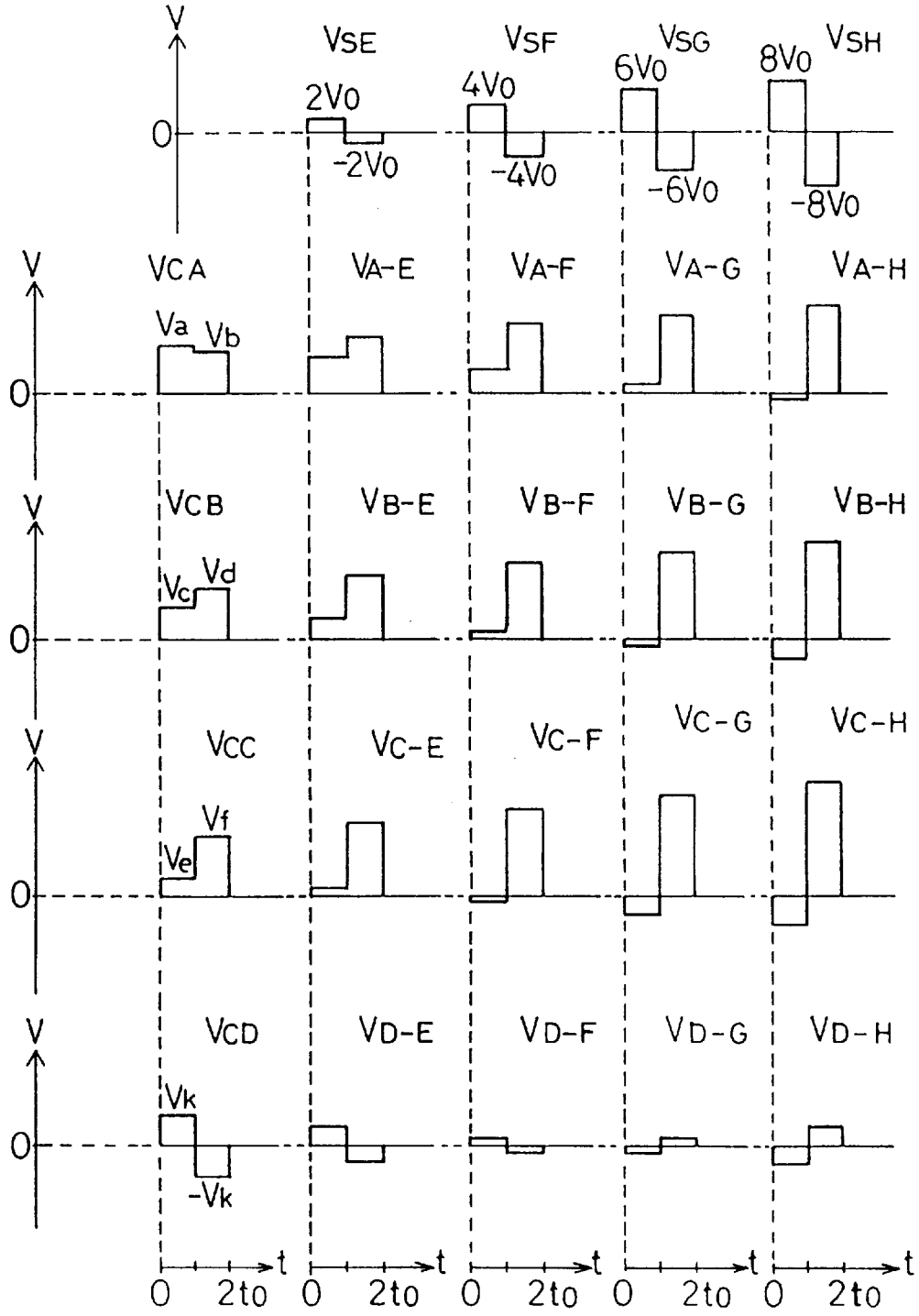
FIG.23 PRIOR ART
FIG. 23 is a waveform illustration showing the waveforms of drive voltages used for achieving a gray scale display with a conventional ferroelectric liquid crystal display apparatus.

In this drive scheme, as shown in FIG. 19, $V_{CA}$ is applied to the scanning electrodes L in the selecting period, and $V_{CB}$ is applied to the scanning electrodes L in a blanking period before the selecting period. $V_{CC}$ is applied to the scanning electrodes L in other periods. When the switching of the display state is not intended, $V_{SD}$ is applied to the segmented electrodes S. On the other hand, when the switching of the display state is intended, $V_{SE}$ is applied to the segmented electrodes S.

A voltage waveform $V_{A-D}$ produced at a pixel by a voltage waveform $V_{CA}$ applied to the scanning electrode L and a voltage waveform $V_{SD}$ applied to the segmented electrode S has a pulse height of $-V_1$ in the first slot and a pulse height of $2V_0+V_1$ in the second slot. Here, $2V_0+V_1>V_{min}$. The state of the pixel is not switched by the voltage waveform $V_{A-D}$.

A voltage waveform $V_{A-E}$ produced at a pixel by a voltage waveform $V_{CA}$ applied to the scanning electrode L and a voltage waveform $V_{SE}$ applied to the segmented electrode S has a pulse height of $V_1$ in the first slot and a pulse height of $2V_0-V_1$ in the second slot. The state of the pixel is switched by the voltage waveform $V_{A-E}$.

When a voltage waveform $V_{CB}$ ($V_0<V_{min}$) shown in FIG. 19 is applied as a blanking voltage to the scanning electrode L twice before the selecting period, the liquid crystal molecules forming the pixels on the scanning electrode turn into one of the stable states after the voltage waveform $V_{B-D}$ or $V_{B-E}$ is applied twice. Thereafter, by applying the voltage waveform $V_{A-D}$ or $V_{A-E}$ depending on whether the state of the pixel is to be switched or not, the pixel is brought into a desired display state. It is thus possible to control the display state of each pixel.

The following description will discuss a drive circuit provided for driving the liquid crystal panel 1 in the ferroelectric liquid crystal display apparatus of this embodiment.

Figure 4:
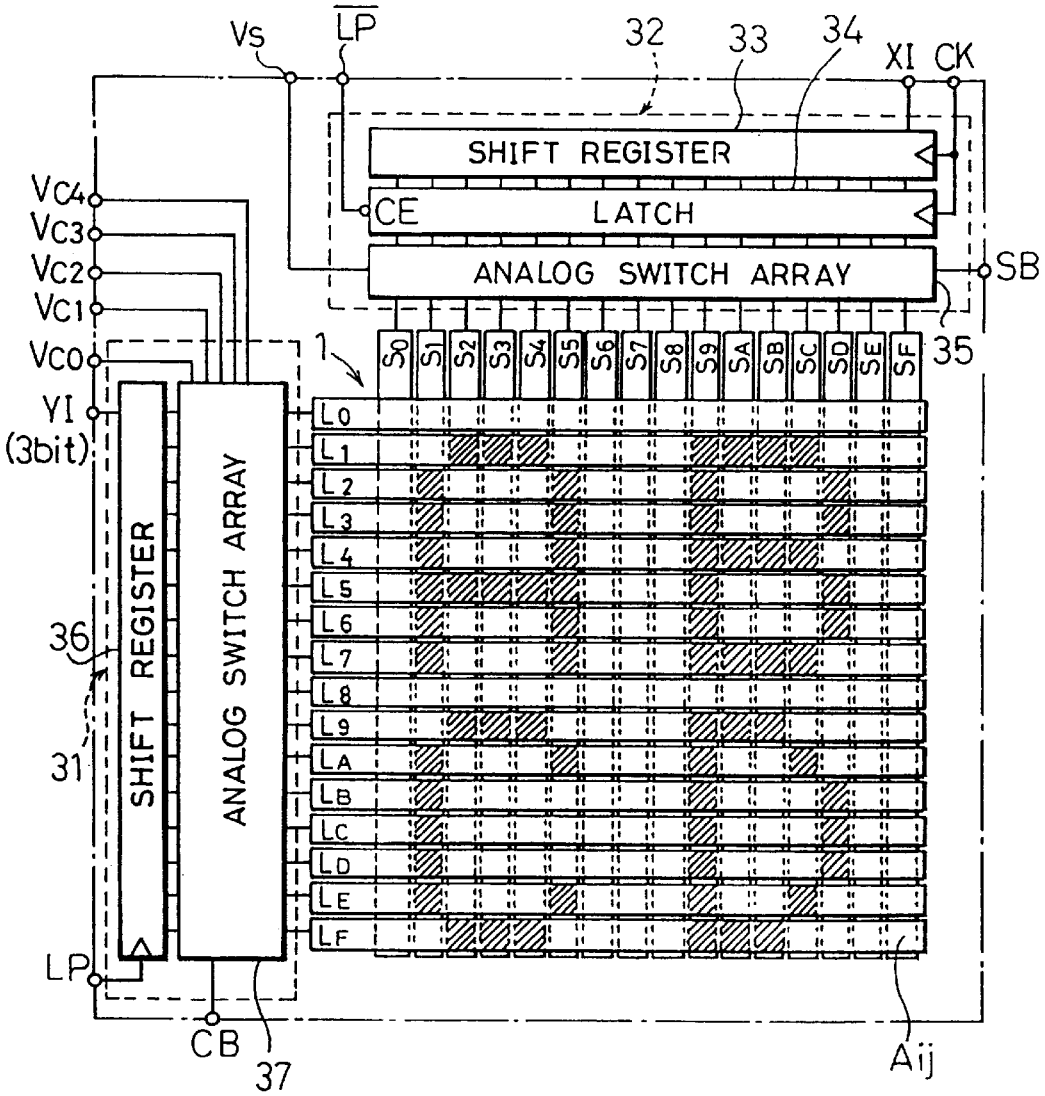
FIG. 4 is a block diagram showing the schematic structures and the connection of the liquid crystal panel, a scanning electrode drive circuit for driving the scanning electrodes of the liquid crystal panel, and a segmented electrode drive circuit for driving the segmented electrodes thereof.

As illustrated in FIG. 4, the drive circuit is formed by a scanning electrode drive circuit 31 and a segmented electrode drive circuit 32. The scanning electrode drive circuit 31 is a circuit for applying a voltage to the scanning electrodes L of the liquid crystal panel 1, and its output terminals are connected to the scanning electrodes L ($L_0$ to $L_F$) of the liquid crystal panel 1. The output terminals of the segmented electrode drive circuit 32 are connected to the segmented electrodes ($S_0$ to $S_F$).

In order to simplify the explanation, in FIG. 4, the liquid crystal panel 1 includes 16 lines of scanning electrodes L and 16 lines of segmented electrodes to form 16×16 pixels. In practice, it is possible to arrange any number of lines of scanning electrodes L and segmented electrodes S according to a desired number of pixels. The intersection of scanning electrode $L_i$ (i=0 to F) and segmented electrode $S_j$ (j=0 to F) is indicated as a pixel $A_{ij}$ in the explanation below.

The scanning electrode drive circuit 31 is formed by a shift register 36 and an analog switch array 37. The shift register 36 is synchronous with a latch pulse LP of positive logic, and outputs a three-bit scanning signal YI to the analog switch array 37 from each output stage. A control signal CB and source voltages $V_{c0}$ to $V_{c4}$ are supplied to the analog switch array 37.

When the control signal CB is "0", the scanning electrode drive circuit 31 makes the electric potential of all of the scanning electrodes L zero irrespectively of the scanning signal YI. When the control signal CB is "1", the scanning electrode drive circuit 31 supplies a voltage waveform corresponding to the value of the scanning signal YI to the scanning electrodes L. This voltage waveform will be discussed in detail later.

Figure 5:
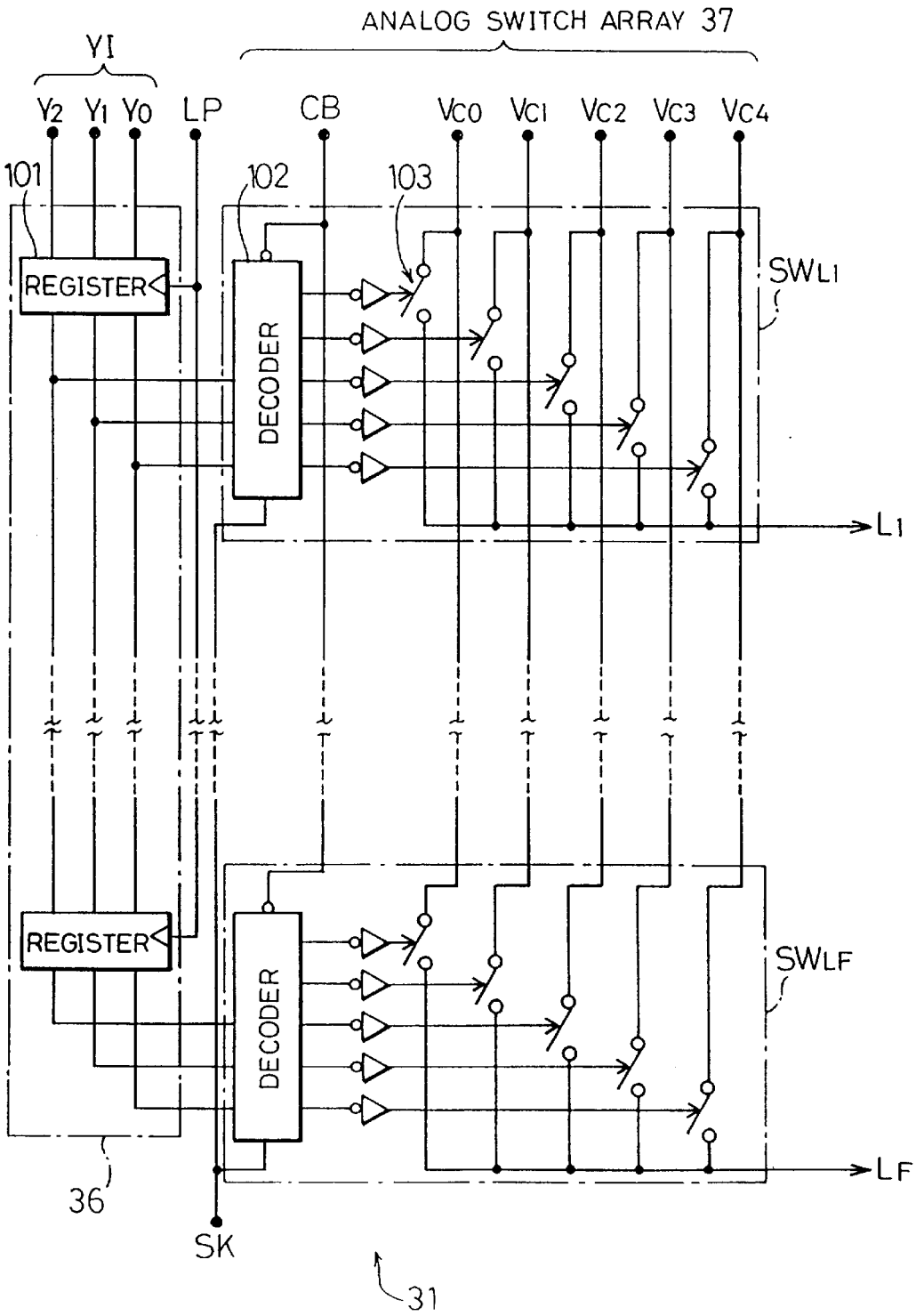
FIG. 5 is a circuit diagram showing the structure of the scanning electrode drive circuit.

Here, the internal structure of the scanning electrode drive circuit 31 will be explained in further detail. As illustrated in FIG. 5, in the analog switch array 37 of the scanning electrode drive circuit 31, one switching circuit SW is provided for each scanning electrode L. For instance, a switching circuit $SW_{L1}$ is connected to a scanning electrode $L_1$. Each switching circuit SW is formed by a decoder 102, and five analog switches 103.

Next, the structure of the segmented electrode drive circuit 32 will be discussed. As illustrated in FIG. 4, the segmented electrode drive circuit 32 is formed by a shift register 33, a latch 34, and an analog switch array 35. A data signal XI and a clock CK are supplied to the shift register 33. The shift register 33 outputs the data signal XI to the latch 34 based on the clock CK. The output data signal XI is synchronized with a latch pulse LP of negative logic, and is held in the latch 34. A control signal SB and a source voltage $V_S$ are supplied to the analog switch array 35. In this case, the source voltage $V_S$ is 0 V.

Figure 1:
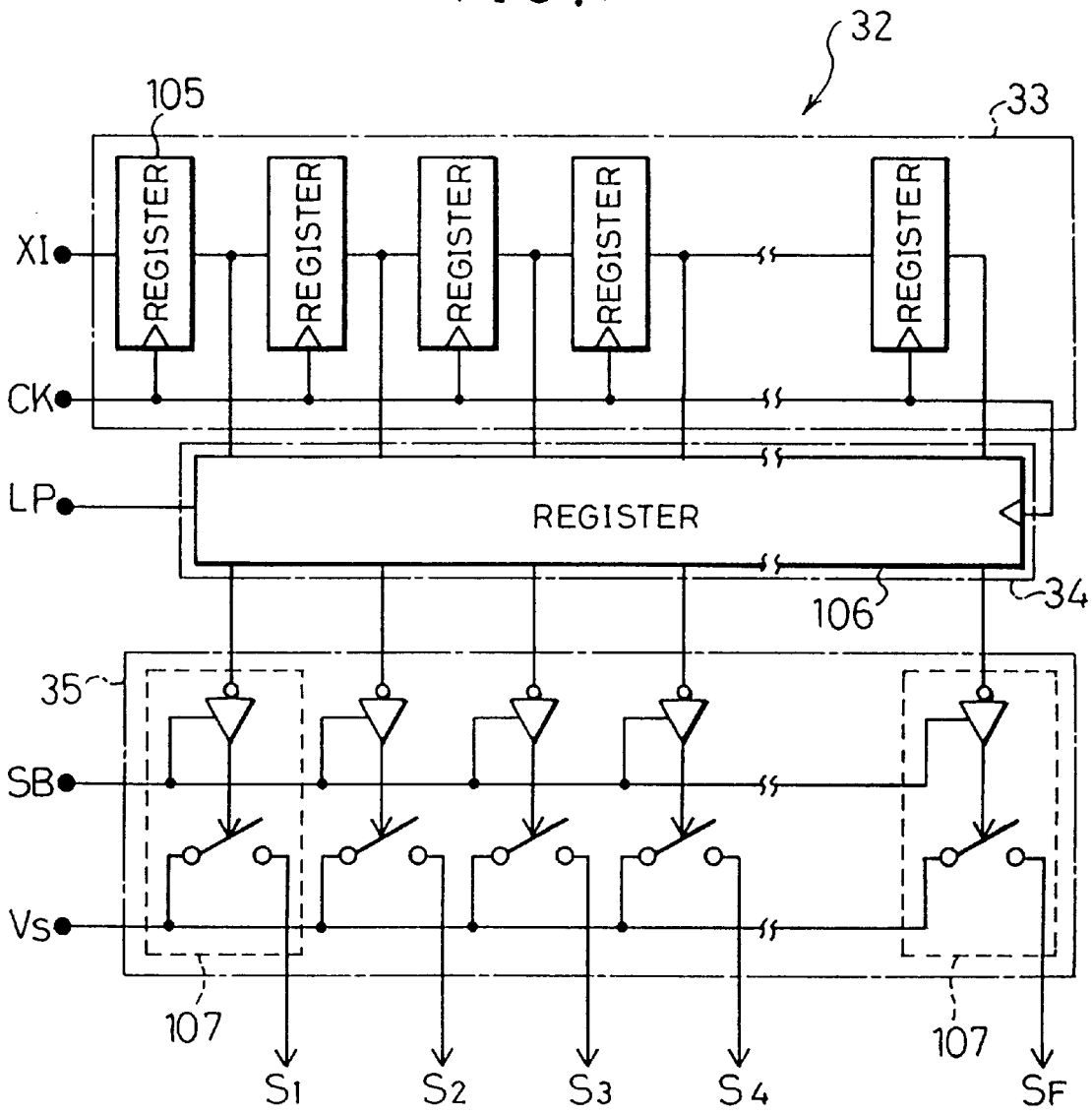
FIG. 1 is a circuit diagram showing the structure of a segmented electrode drive circuit in a ferroelectric liquid crystal display apparatus according to one embodiment of the present invention.

The internal structure of the segmented electrode drive circuit 32 is shown in FIG. 1. The shift register 33 is formed by the registers 105. The latch 34 is achieved by a register 106. The analog switch array 35 is formed by the same number of analog switches 107 as the segmented electrodes S.

When the control signal SB is "0", the output of the analog switch 107 has an electric potential of zero irrespectively of the data signal XI. When the control signal SB is "1", the output of the analog switch 107 has an electric potential of zero or a high impedance state depending on the data signal XI.

Next, the following description will discuss a drive voltage to be applied to the liquid crystal panel 1 by the scanning electrode drive circuit 31 and the segmented electrode drive circuit 32.

Figure 6:
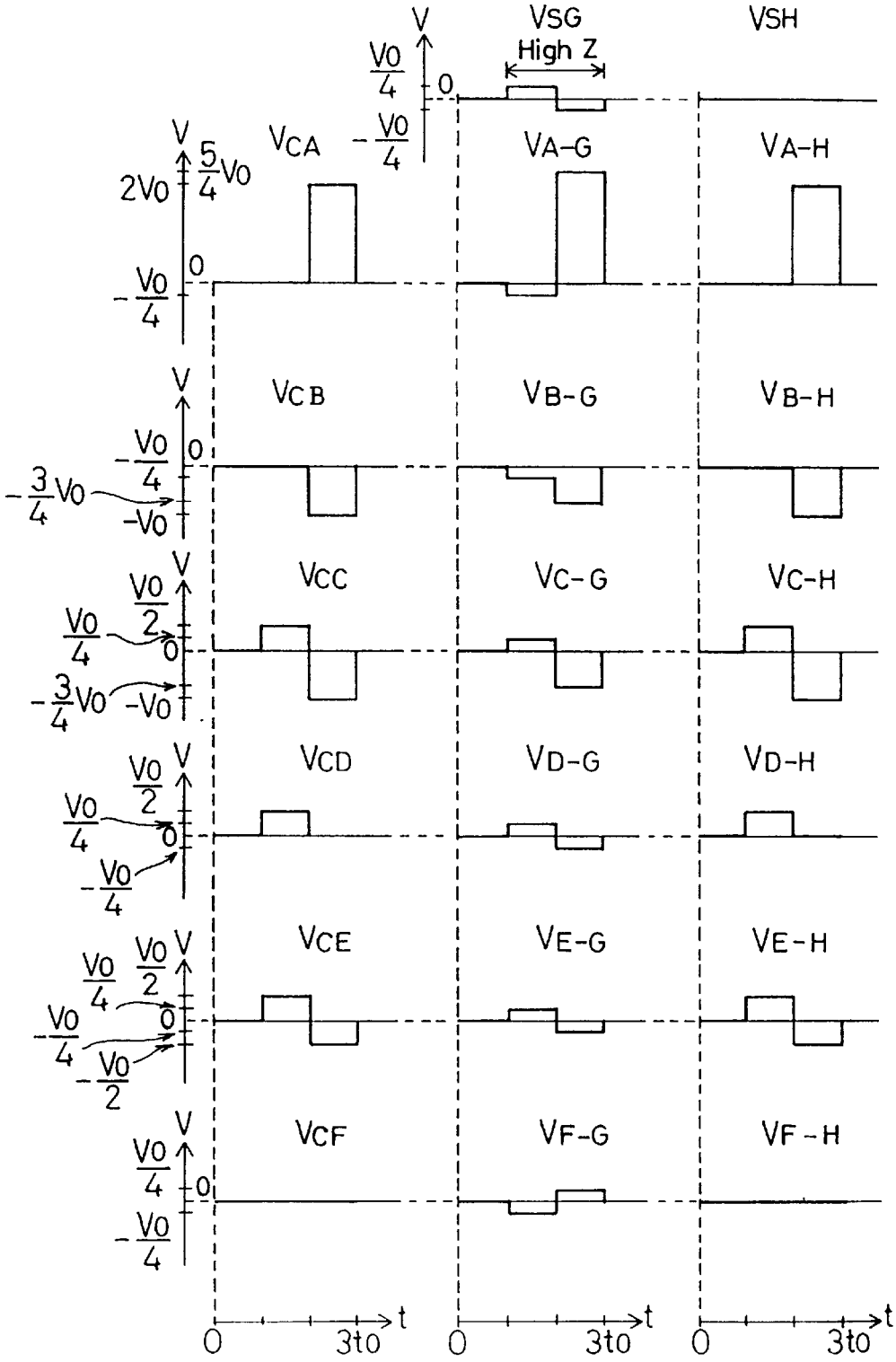
FIG. 6 is a waveform illustration showing the waveforms of drive voltages applied by the scanning electrode drive circuit and the segmented electrode drive circuit.

The switching circuits SW in the analog switch array 37 of the scanning electrode drive circuit 31 are supplied with $V_{c0}=2V_0$, $V_{c1}=1/2V_0$, $V_{c2}=0$, $V_{c3}=-1/2V_0$, and $V_{c4}=2V_0$, and output one of the voltage waveforms $V_{CA}$, $V_{CB}$, $V_{CC}$, $V_{CD}$, $V_{CE}$ and $V_{CF}$ shown in FIG. 6 to the scanning electrodes L based on the scanning signal YI and the control signals CB and SK. The scanning signal YI is input as a three-bit signal ($Y_0Y_1Y_2$). The relationship among the input scanning signal YI, control signals CB and SK, and the output voltage waveform is shown below.

TABLE 1

| ($Y_0Y_1Y_2$) | 000 | 001 | 010 | 011 | 100 | 101 |
|---|---|---|---|---|---|---|
| Voltage waveform | $V_{CA}$ | $V_{CB}$ | $V_{CC}$ | $V_{CD}$ | $V_{CE}$ | $V_{CF}$ |
| CB = 0 SK = arbitrary value | $V_{C2}$ | $V_{C2}$ | $V_{C2}$ | $V_{C2}$ | $V_{C2}$ | $V_{C2}$ |
| CB = 1 SK = 0 | $V_{C2}$ | $V_{C2}$ | $V_{C1}$ | $V_{C1}$ | $V_{C1}$ | $V_{C2}$ |
| CB = 1 SK = 1 | $V_{C0}$ | $V_{C4}$ | $V_{C4}$ | $V_{C2}$ | $V_{C3}$ | $V_{C2}$ |

For example, 5, 4, 4, 3, 2, 1, 1, 0, 5, 4 . . . are supplied in this order as the scanning signal YI (decimal notation), the voltage waveforms $V_{CF}$, $V_{CE}$, $V_{CE}$, $V_{CD}$, $V_{CC}$, $V_{CB}$, $V_{CB}$, $V_{CA}$, $V_{CF}$, $V_{CE}$ . . . are successively applied to the scanning electrode $L_0$, and the voltage waveforms $V_{CE}$, $V_{CF}$, $V_{CE}$, $V_{CE}$, $V_{CD}$, $V_{CC}$, $V_{CB}$, $V_{CB}$, $V_{CA}$, $V_{CF}$ . . . are successively applied to the scanning electrode $L_1$.

The voltage waveform $V_{CA}$ is a selection voltage to be applied to the scanning electrode during the selecting period. The voltage waveform $V_{CB}$ is a blanking voltage to be applied to the scanning electrode before the selecting period. The voltage waveforms $V_{CC}$, $V_{CD}$, $V_{CE}$ and $V_{CF}$ is the waveforms of non-selection voltages to be applied to the scanning electrode during non-selecting periods other than the blanking period when the blanking voltage is applied.

In the scanning electrodes L, the selecting period during which a certain line of scanning electrode is selected has a duration equal to three slots ($3t_0$). As illustrated in FIG. 6, in all of the voltages waveforms $V_{CA}$ to $V_{CF}$, the first slot (0 to $t_0$) is 0 V. Namely, as the control signal CB of the scanning electrode drive circuit 31, "0" is supplied in the first slot (0 to $t_0$), and "1" is supplied in the second and third slots ($t_0$ to $3t_0$). In the second slot ($t_0$ to $2t_0$), "0" is supplied as the control signal SK. In the third slot ($2t_0$ to $3t_0$), "1" is supplied as the control signal SK.

In the segmented electrode drive circuit 32, as the control signal SB, "0" is supplied in the first slots (0 to $t_0$), and "1" is supplied in the second and third slots ($t_0$ to $3t_0$) Namely, the output of the segmented electrode drive circuit 32 to the segmented electrodes S has an electric potential of zero in the first slot, and has either a high impedance state or an electric potential of zero in the second and third slots depending on the contents of the data signal XI.

Figure 7:
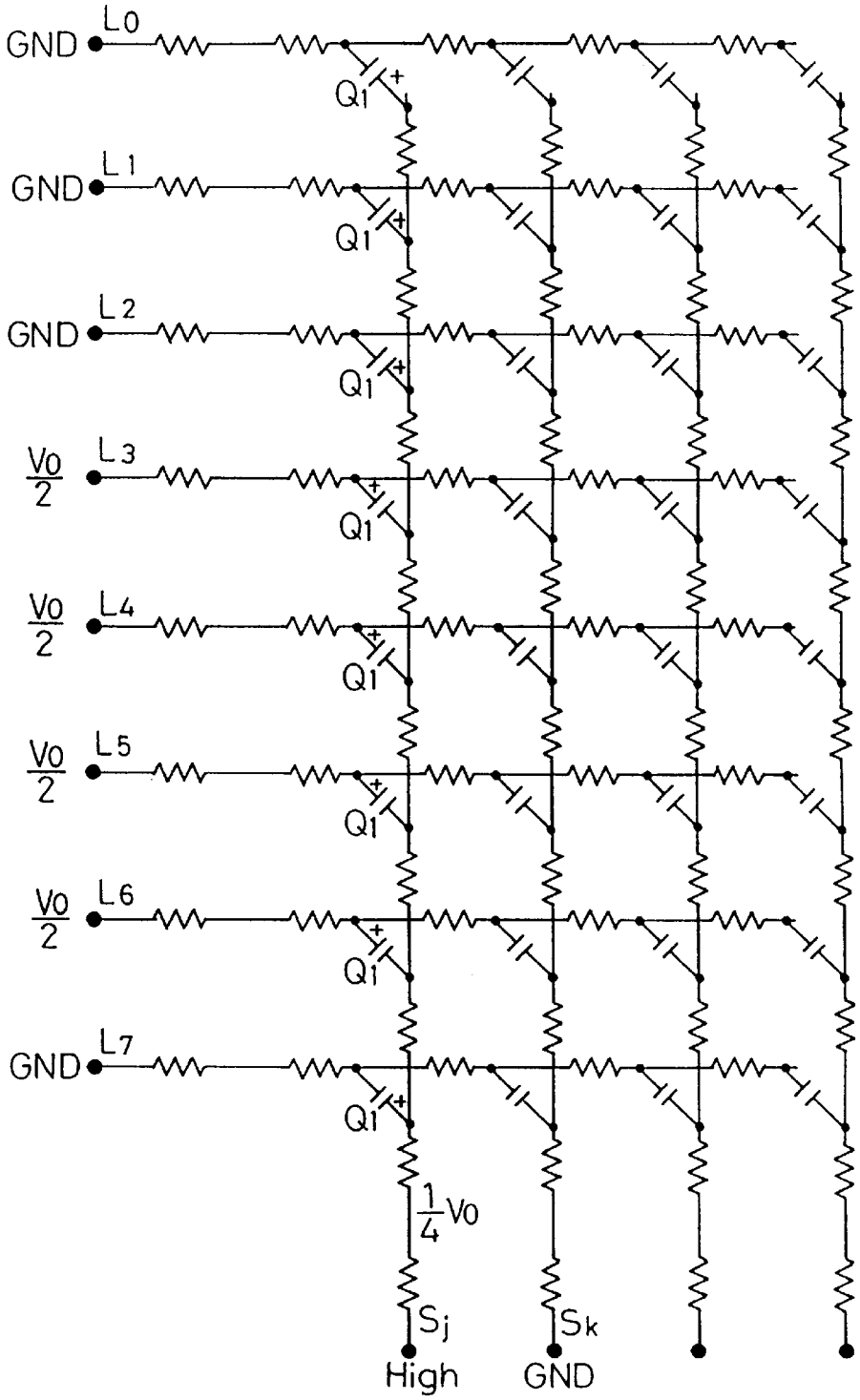
FIG. 7 is a circuit diagram of a part of a RC equivalent circuit of the scanning electrode and the segmented electrode.
Figure 8:
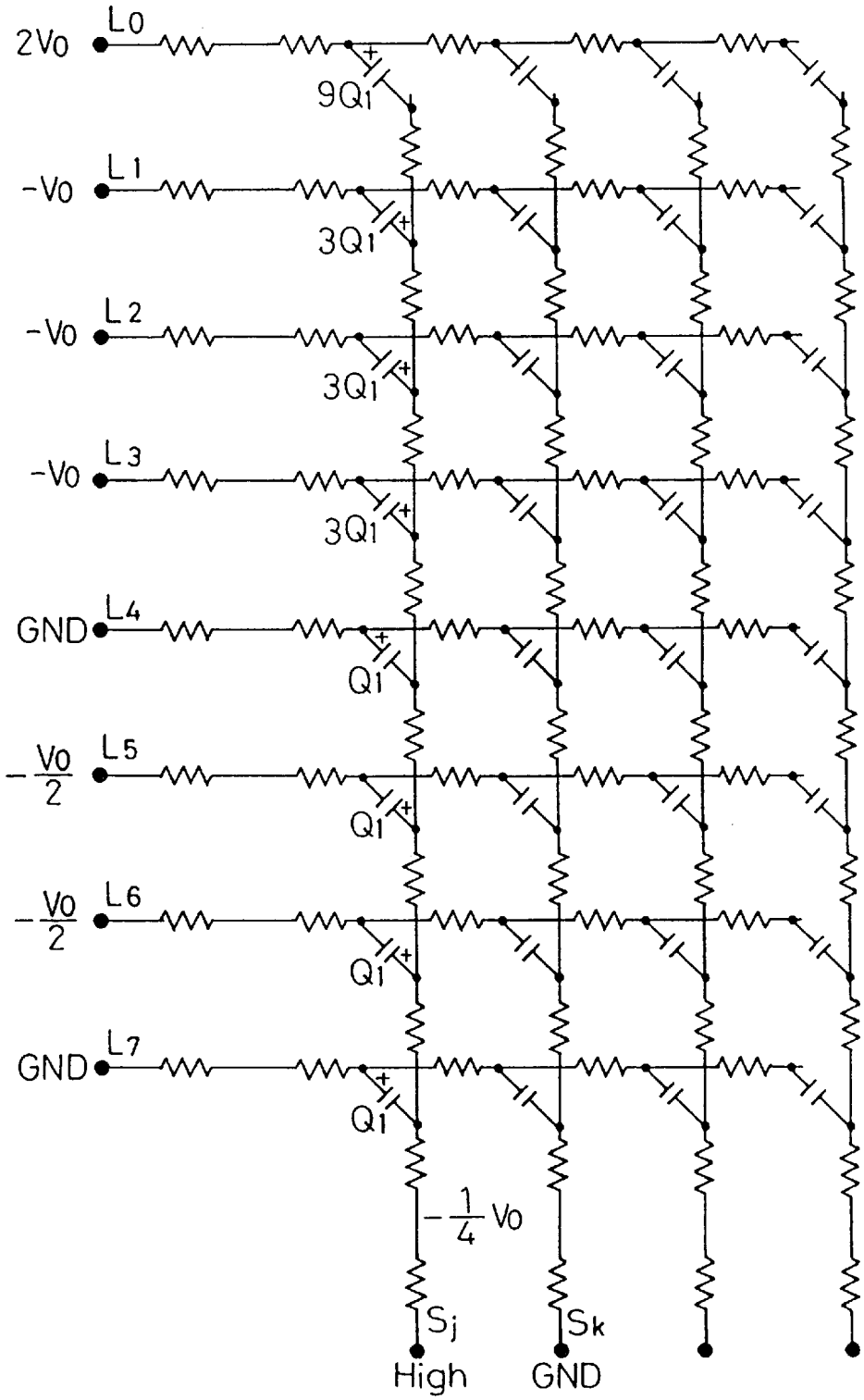
FIG. 8 is a circuit diagram of a part of a RC equivalent circuit of the scanning electrode and the segmented electrode.

The following description will discuss the electric potential produced in the segmented electrode connected to the output terminal in high impedance state of the segmented electrode drive circuit 32 with reference to a RC equivalent circuit shown in FIGS. 7 and 8. In order to simplify the explanation, the following explanation is made with reference to two lines of segmented electrodes $S_j$ and $S_k$, and eight lines of scanning electrodes $L_0$ to $L_7$ capacitive-coupled to these segmented electrodes.

In the first slot, since the electric potential of all of the scanning electrodes L and the segmented electrodes S is zero, the electric charges of all of the pixels on the segmented electrodes $S_j$ and $S_k$ are zero.

In the second slot, "1" is supplied as the control signal SB to the segmented electrode drive circuit 32. Consequently, the output from the output terminal of the segmented electrode drive circuit 32 to the segmented electrodes has either a high impedance state or an electric potential of zero depending on the data signal XI. In FIG. 7, electric potentials of 0, 0, 0, $V_0/2$, $V_0/2$, $V_0/2$, $V_0/2$ and 0 are applied to the scanning electrodes $L_0$ to $L_7$, respectively, in the second slot, the segmented electrode $S_j$ has a high impedance state, and the segmented electrode $S_k$ has an electric potential of zero.

In this case, since the output terminal connected to the segmented electrode $S_j$ has a high impedance state, electric charges are not input/output from the segmented electrode drive circuit 32 to the segmented electrode $S_j$. Moreover, a liquid crystal is present at each intersection of the scanning electrodes L and the segmented electrodes S of the liquid crystal panel 1, i.e., at each pixel, and forms a capacitive load. Therefore, the electric charges held by the pixels on the segmented electrode $S_j$ of high impedance state are not readily discharged, and are retained. Namely, the segmented electrode $S_j$ keeps a voltage just before the output terminal of the segmented electrode drive circuit 32 turns into the high impedance state.

More specifically, the electric potential produced in the segmented electrode $S_j$ of high impedance state in the second slot is given by $$V_{Lav}+Q_{total}/C_{total}$$

where $V_{Lav}$ is the average electric potential of all of the scanning electrodes capacitive-coupled to the segmented electrode $S_j$, $Q_{total}$ is the total of the electric charges remaining on the pixels on the segmented electrode $S_j$, and $C_{total}$ is the total capacity between the segmented electrode $S_j$ and all of the scanning electrodes capacitive-coupled to the segmented electrode $S_j$.

In the segmented electrode $S_j$, since $V_{Lav}$ is $V_0/4$ and the electric charges injected to the segmented electrode $S_j$ in the first slot is zero, $Q_{total}$ is zero. Namely, an electric potential of $V_0/4$ appears on the segmented electrode $S_j$ in the second slot.

In other words, such an electric potential that causes no electric charge to be output/input to the segmented electrode $S_j$ of high impedance state and the total of electric charges on all of the pixels on the segmented electrode $S_j$ to be zero, i.e., the average electric potential of all of the capacitive-coupled scanning electrodes appears on the segmented electrode $S_j$.

In the following third slot, as illustrated in FIG. 8, voltages of $2V_0$, $-V_0$, $-V_0$, $-V_0$, 0, $-V_0/2$, $-V_0/2$, 0 are applied to the scanning electrodes $L_0$ to $L_7$, respectively, and $V_{Lav}$ is $-V_0/4$. Since the electric charges injected in the first slot is zero and no electric charge is input/output in the second slot because of the high impedance state of the segmented electrode $S_j$, $Q_{total}$ is zero. Consequently, an electric potential of $-V_0/4$ appears on the segmented electrode $S_j$ in the third slot.

The electric potential $-V_0/4$ of the segmented electrode $S_j$ may also be obtained as follows.

Assuming that the electric charges on the pixels formed at the intersections of the segmented electrode $S_j$ and the scanning electrodes $L_0$ to $L_7$ are $Q_a$, $Q_b$, $Q_c$, $Q_d$, $Q_e$, $Q_f$, $Q_g$, $Q_h$, respectively, each of the pixels has a uniform capacity C, and the segmented electrode $S_j$ has an electric potential $V_X$, the following equations are written:

$$Q_a=C(2V_0-V_X) \quad \text{equation (1)}$$

$$Q_b=C(-V_0-V_X) \quad \text{equation (2)}$$

$$Q_c=C(-V_0-V_X) \quad \text{equation (3)}$$

$$Q_d=C(-V_0-V_X) \quad \text{equation (4)}$$

$$Q_e=C(0-V_X) \quad \text{equation (5)}$$

$$Q_f=C(-V_0/2-V_X) \quad \text{equation (6)}$$

$$Q_g=C(-V_0/2-V_X) \quad \text{equation (7)}$$

$$Q_h=C(0-V_X) \quad \text{equation (8)}$$

It is known from these equations that $Q_b=Q_c=Q_d$ $Q_e=Q_h$ $Q_f=Q_g$

Since the total, $Q_{total}$, of the electric charges remaining on the pixels on the segmented electrode $s_j$ is zero, it is written that $$Q_a+Q_b+Q_c+Q_d+Q_e+Q_f+Q_g+Q_h=0$$

Then, $$Q_a+3Q_b+2Q_e+2Q_f=0$$

By substituting equations (1), (2), (5) and (6) for this equation, it is written that $$V_x=-V_0/4$$

The following equation is obtained from $V_x$ and equation (8).

$$Q_h=C(0+V_0/4)=CV_0/4$$

If $Q_h=Q_1$, as shown in FIG. 8, $$Q_a=9Q_1$$

$$Q_b=Q_c=Q_d=-3Q_1$$

$$Q_e=Q_h=Q_1$$

$$Q_f=Q_g=-Q_1$$

Thus, by applying the voltage waveforms $V_{CA}$, $V_{CB}$, $V_{CB}$, $V_{CC}$, $V_{CD}$, $V_{CE}$, $V_{CE}$ and $V_{CF}$ shown in FIG. 6 to the scanning electrodes $L_0$ to $L_7$, respectively, and by switching the control signals CB and SB between ON and OFF in the manner mentioned above, the electric potential of the segmented electrode $S_j$ which causes an output from the segmented electrode drive circuit 32*a* to be in a high impedance state has the voltage waveform VSG shown in FIG. 6. On the other hand, the electric potential of the segmented electrode $S_k$ which causes an output from the segmented electrode drive circuit 32 to have an electric potential of zero has the voltage waveform $V_{SH}$.

Consequently, the voltage waveform $V_{A-G}$ or $V_{A-H}$ is applied to the pixels on the scanning electrode to which the selection voltage ($V_{CA}$) is applied, depending on the data signal XI. The voltage waveform $V_{A-G}$ has a pulse height of 0 V in the first slot, $-V_0/4$ in the second slot, and $2V_0+V_0/4=5V_0/4$ in the third slot. The voltage waveform $V_{A-G}$ does not switch the state of pixel. On the other hand, the voltage waveform $V_{A-H}$ has a pulse height of 0 V in the first slot, 0 V in the second slot and $2V_0$ in the third slot, and switches the state of pixel.

Figure 9:
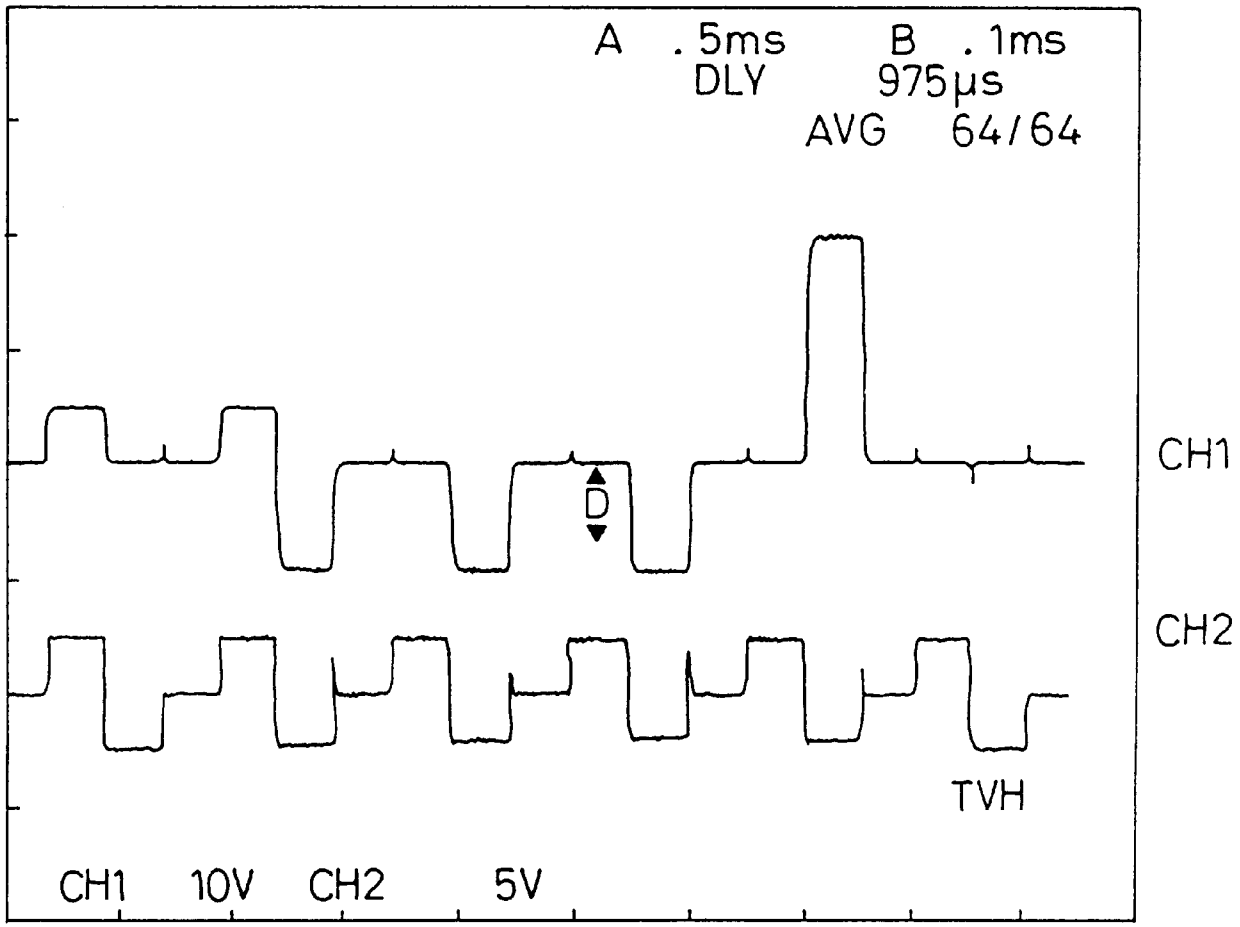
FIG. 9 is an explanatory view showing the display of an oscilloscope when measuring the waveforms of drive voltages applied to the segmented electrodes by the segmented electrode drive circuit.
Figure 10:
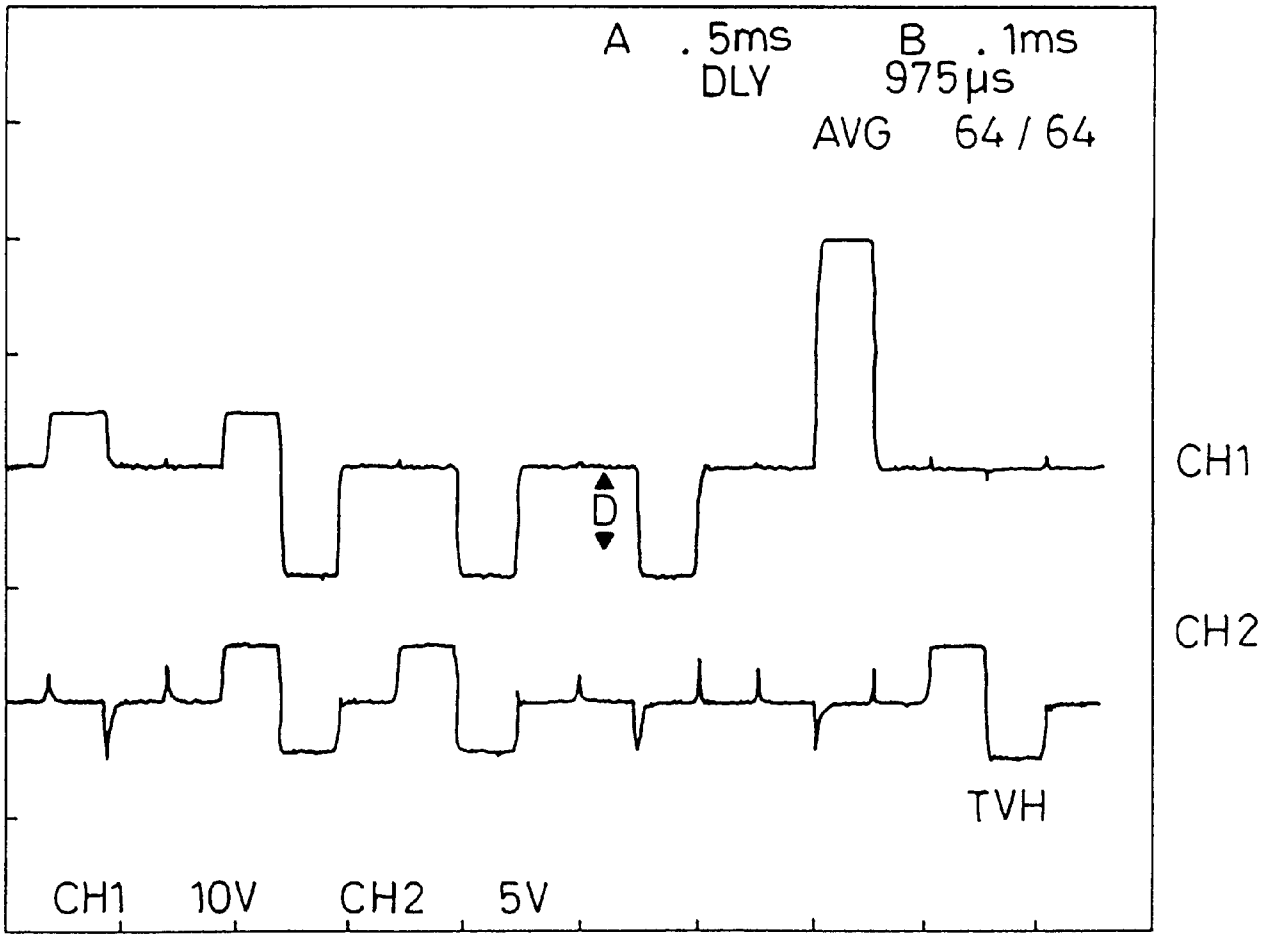
FIG. 10 is an explanatory view showing the display of the oscilloscope when measuring the waveforms of drive voltages applied to the segmented electrodes by the segmented electrode drive circuit.

The electric potential of the segmented electrode $S_j$ was actually examined using an oscilloscope. As a result, the voltage waveform $V_{SG}$ appeared on CH2 as shown in FIG. 9. When the data signal XI was switched every six slots equivalent to two selecting periods, it was confirmed that the two voltage waveforms $V_{SG}$ and two voltage waveforms $V_{SH}$ alternately appeared on CH2 as shown in FIG. 10 and a plurality of electric potentials were generated in the segmented electrode $S_j$.

As described above, in this embodiment, it is possible to arrange the number of analog switches per segmented electrode to be one in the segmented electrode drive circuit 32, thereby simplifying the structure of the segmented electrode drive circuit 32. Therefore, when forming the segmented electrode drive circuit 32 as an IC, if the area of a silicon wafer and the number of output terminals per IC are fixed, the area of each analog switch can be increased and the output impedance can be lowered compared to the structure requiring two analog switches for each output terminal. On the other hand, if a lowering of the output impedance is not required, it is possible to reduce the area of the silicon wafer per IC on condition that the number of output terminals is fixed. It is therefore possible to produce a drive circuit of a passive-matrix type liquid crystal display apparatus at reduced costs.

Embodiment 2

The following description will discuss another embodiment of the present invention with reference to FIGS. 11 to 15 and 23. The structures performing the same functions as in Embodiment 1 will be designated with the same numbers, and the explanation thereof will be omitted.

A liquid crystal panel in a ferroelectric liquid crystal display apparatus of this embodiment has the same structure as that of the liquid crystal panel 1 of Embodiment 1 except for the electrode structure.

Figure 11:
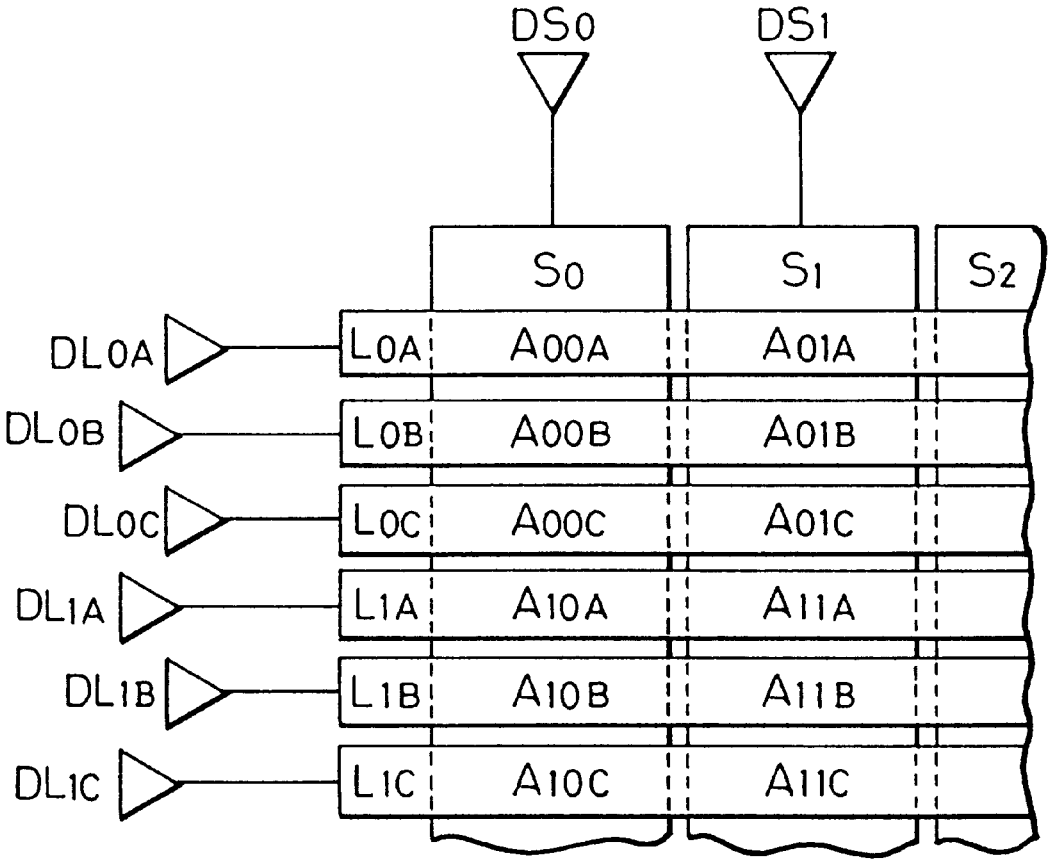
FIG. 11 is an explanatory view showing the electrode structure of a ferroelectric liquid crystal display apparatus according to another embodiment of the present invention.

FIG. 11 is a plan view showing the electrode structure of the liquid crystal panel of this embodiment. In this liquid crystal panel, one pixel is formed by three lines of scanning electrodes and one line of segmented electrode. In the description below, three pixels formed by three lines of scanning electrodes $L_{iA}$, $L_{iB}$ and $L_{iC}$ (i=0, 1 . . . ) and one line of segmented electrode $S_j$ (j=0, 1 . . . ) are referred to as sub-pixels $A_{ijA}$, $A_{ijB}$ and $A_{ijC}$, respectively. The three sub-pixels $A_{ijA}$, $A_{ijB}$ and $A_{ijC}$ form one pixel $A_{ij}$. A scanning electrode drive circuit is connected to the scanning electrodes L through output terminals $DL_{iA}$, $DL_{iB}$ and $DL_{iC}$. A segmented electrode drive circuit is connected to the segmented electrodes S through an output terminal $DS_j$.

The ferroelectric liquid crystal display apparatus of this embodiment achieves a multiple gray scale display by the following drive scheme.

Figure 13:
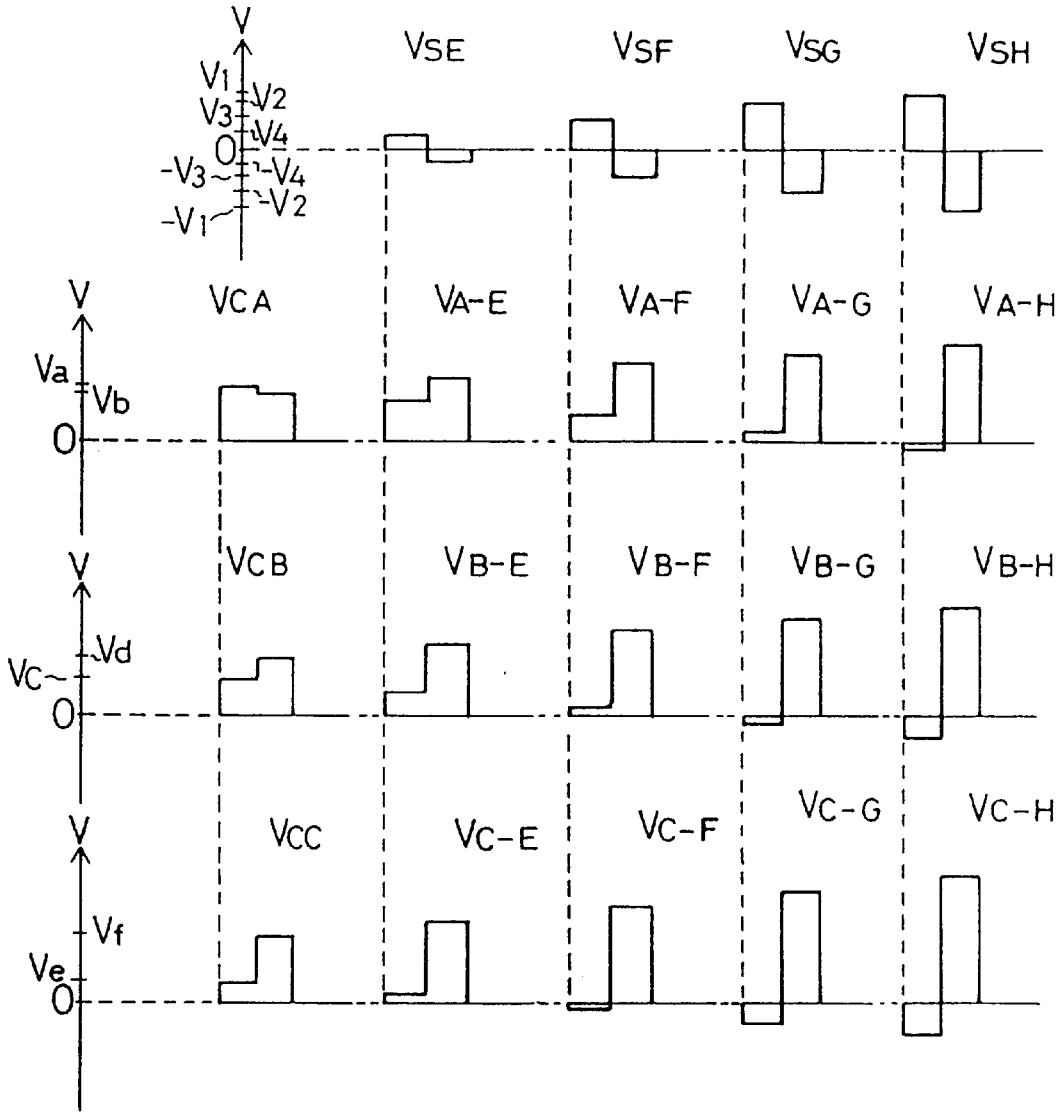
FIG. 13 is a waveform illustration showing the. waveforms of drive voltages applied to the scanning electrodes and the segmented electrodes of the ferroelectric liquid crystal display apparatus of FIG. 11 in the selecting period.

In the scanning electrodes L, the three lines of scanning electrodes $L_{iA}$, $L_{iB}$ and $L_{iC}$ forming one pixel are selected at a time. However, as to be described later, the waveforms of selection voltages to be applied to the three lines of scanning electrodes in a selecting period differ from each other as shown in FIG. 13. In a scanning method employed by this drive scheme, first, three lines of scanning electrodes $L_{0A}$, $L_{0B}$ and $L_{0C}$ are simultaneously selected, and a non-selection voltage is applied to other scanning electrodes. Next, three lines of scanning electrodes $L_{1A}$, $L_{1B}$ and $L_{1C}$ are simultaneously selected, and a non-selection voltage is applied to other scanning electrodes.

Figure 12:
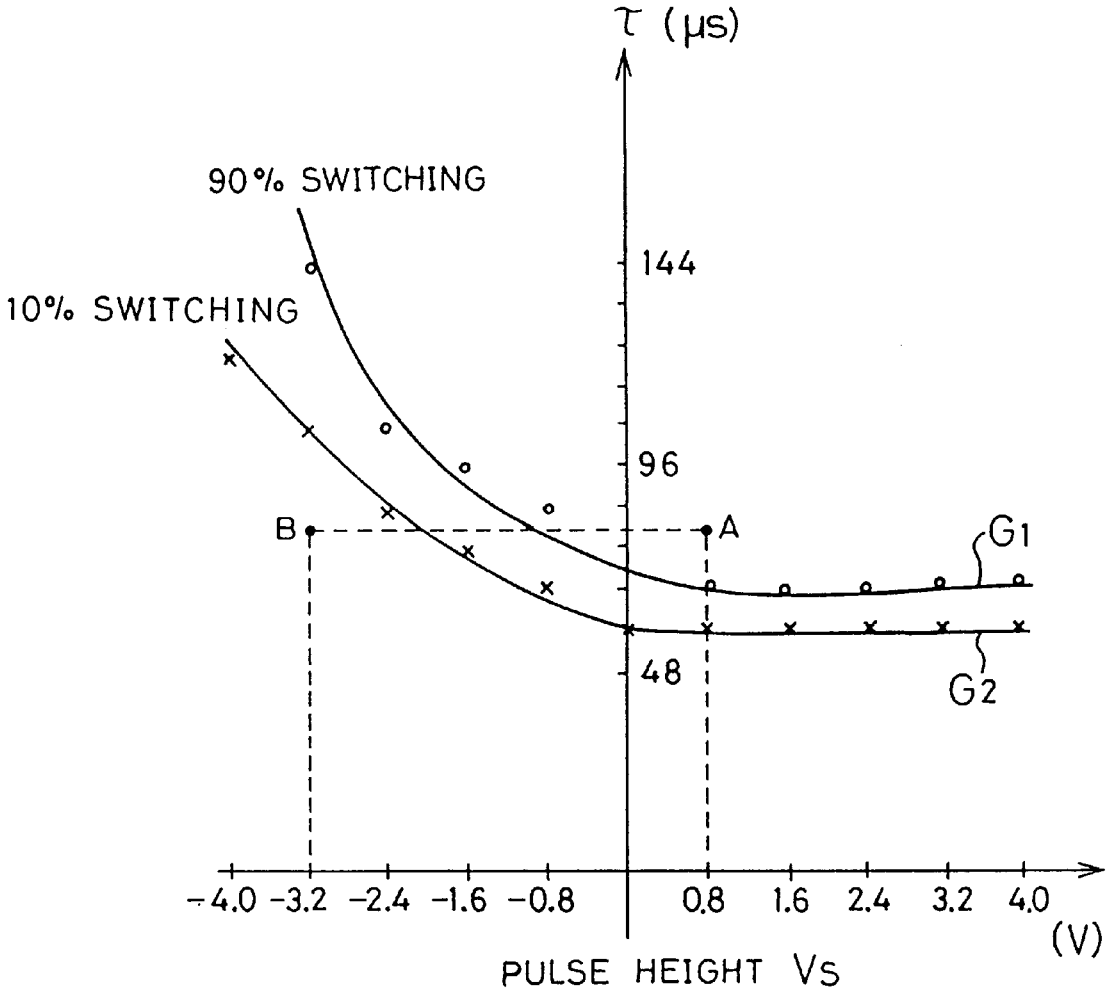
FIG. 12 is a graph showing a pulse width r at which 90% or 10% of the liquid crystal molecules in the pixel switch against the pulse height $V_S$ of the first pulse when two pulses having the same width are continuously applied.

In FIG. 12, $G_1$ shows the relationship between the pulse height $V_S$ and pulse width $\tau$ of a pulse in the first slot required for switching 90 percent of the region of the pixel, and $G_2$ shows the relationship between the pulse height $V_S$ and pulse width $\tau$ of a pulse in the first slot required for switching 10 percent of the region of the pixel when pulses of two slots with equal width are successively applied to the pixel of the liquid crystal panel of this embodiment (i.e., when a voltage having a pulse height $V_S$ is applied in the first slot and a voltage having a pulse height $(40-V_S)$ is applied in the second slot).

As is clear from FIG. 12, for example, when the pulse width is 80 $\mu$s, in order to switch the pixel, it is necessary to apply a switching voltage waveform so that the pulse height $V_S$ in the first slot is, for example, a pulse height ($V_S$=0.8 V) at point A in a region higher than a threshold value ($G_1$) for switching 90 percent of the region and that the pulse height in the second slot is 39.2 V.

On the other hand, when the pixel is not to be switched, it is necessary to apply a non-switching voltage waveform so that the pulse height $V_S$ in the first slot is, for example, a pulse height ($V_S$=−3.2 V) at point B in a region lower than a threshold value ($G_2$) for switching 10 percent of the region and that the pulse height in the second slot is 43.2 V.

FIG. 13 is a waveform illustration of three kinds of selection voltages applied to the scanning electrodes $L_{iA}$, $L_{iB}$ and $L_{iC}$ and a signal voltage applied to the segmented electrodes S, for achieving the above-mentioned switching waveform and non-switching waveform, and the resultant switching voltage waveform and non-switching voltage waveform.

$V_{CA}$, $V_{CB}$ and $V_{CC}$ shown in FIG. 13 are selection voltages applied to the scanning electrodes $L_{iA}$, $L_{iB}$ and $L_{iC}$, respectively, in the selecting period. $V_{SE}$, $V_{SF}$, $V_{SG}$ and $V_{SH}$ shown in FIG. 13 are signal voltages applied to the segmented electrode $S_j$ in the selecting period.

In this case, $V_a$ to $V_f$ and $V_1$ to $V_4$ shown in FIG. 13 satisfy the following conditions at the same time.

$$V_e-V_4=V_c-V_3=V_a-V_2=0.8\ V$$

$$V_f+V_4=V_d+V_3=V_b+V_2=39.2\ V$$

$$V_e-V_3=V_c-V_2=V_a-V_1=-3.2\ V$$

$$V_f+V_3=V_d+V_2=V_b+V_1=43.2\ V$$

$$V_1=V_2+4\ V=V_3+8\ V=V_4+12\ V$$

$$V_a=V_c+4\ V=V_e+8\ V$$

$$V_f=V_d+4\ V=V_b+8\ V$$

$$V_e=V_4+0.8\ V$$

Although $V_f$ and $V_1$ can be determined arbitrarily, it is arranged in this case that $V_f=V_1=25.6$ V. Accordingly, $V_d=V_2=21.6$ V, $V_b=V_3=17.6$ V, $V_4=13.6$ V. $V_e=14.4$ V, $V_c=18.4$ V, and $V_a=22.4$ V.

By arranging the pulse height in the first slot to be $aV_0$ ($-1<a<1$, $V_0=40$ V), the pulse height in the second slot to be $(1-a)V_0$, and the pulse width in the first and second slots to be the same, it is possible to readily achieve a DC balance of liquid crystal molecules constituting a pixel.

In this case, when $V_{SE}$ is applied to the segmented electrode $S_j$ in the selecting period, all of the three sub-pixels $A_{ijA}$, $A_{ijB}$ and $A_{ijC}$ are switched to one of the stable states as shown in FIG. 12 by the waveforms $V_{A-E}$, $V_{B-E}$ and $V_{C-E}$ applied to $A_{ijA}$, $A_{ijB}$ and $A_{ijC}$, respectively. When $V_{SF}$ is applied to the segmented electrode $S_j$, the sub-pixels $A_{ijA}$ and $A_{ijB}$ are switched to one of the stable states but $A_{ijC}$ is not switched by the waveforms $V_{A-F}$, $V_{B-F}$ and $V_{C-F}$. When $V_{SG}$ is applied to the segmented electrode $S_j$, only the sub-pixel $A_{ijA}$ is switched to one of the stable states, and sub-pixels $A_{ijB}$ and $A_{ijC}$ are not switched. When $V_{SH}$ is applied to the segmented electrode $S_j$, none of the sub-pixels $A_{ijA}$, $A_{ijB}$ and $A_{ijC}$ are switched. It is thus possible to achieve displays in four levels of gray scale.

With the achievement of such driving, when ferroelectric liquid crystals having negative dielectric anisotropy are used, the memory pulse width of ferroelectric liquid crystal molecules varies depending on two successive pulses. Specifically, when the pulses are of the same polarity, $E_{min}$ becomes greater and $\tau_{min}$ becomes smaller against the voltage in the second slot as the absolute value of the voltage in the first slot increases. On the other hand, when the pulses have the opposite polarities, $E_{min}$ becomes smaller and $\tau_{min}$ becomes greater against the voltage in the second slot as the absolute value of the voltage in the first slot increases. In this embodiment, the polarity of the voltage in the second slot is determined on condition that it switches the liquid crystal molecules to one of the stable states.

The above-mentioned values of the voltages $V_a$, $V_b$, $V_c$, $V_d$, $V_e$, $V_f$, $V_1$, $V_2$, $V_3$ and $V_4$ are merely examples, and these voltages are arbitrarily determined within a range satisfying all of the following conditions.

$$V_a>V_c>V_e>0$$

$$V_a+V_b=V_c+V_d=V_e+V_f$$

$$V_a-V_3=V_c-V_4$$

$$V_c-V_3=V_e-V_4$$

$$V_a-V_2=V_c-V_3$$

$$V_c-V_2=V_e-V_3$$

$$V_a-V_1=V_c-V_2$$

$$V_c-V_1=V_e-V_2$$

$$V_4<V_3<V_2<V_1$$

The waveforms applied to the pixels in the selecting period has been explained above. Next, the waveforms applied to the pixels in the non-selecting period will be discussed.

Figure 14:
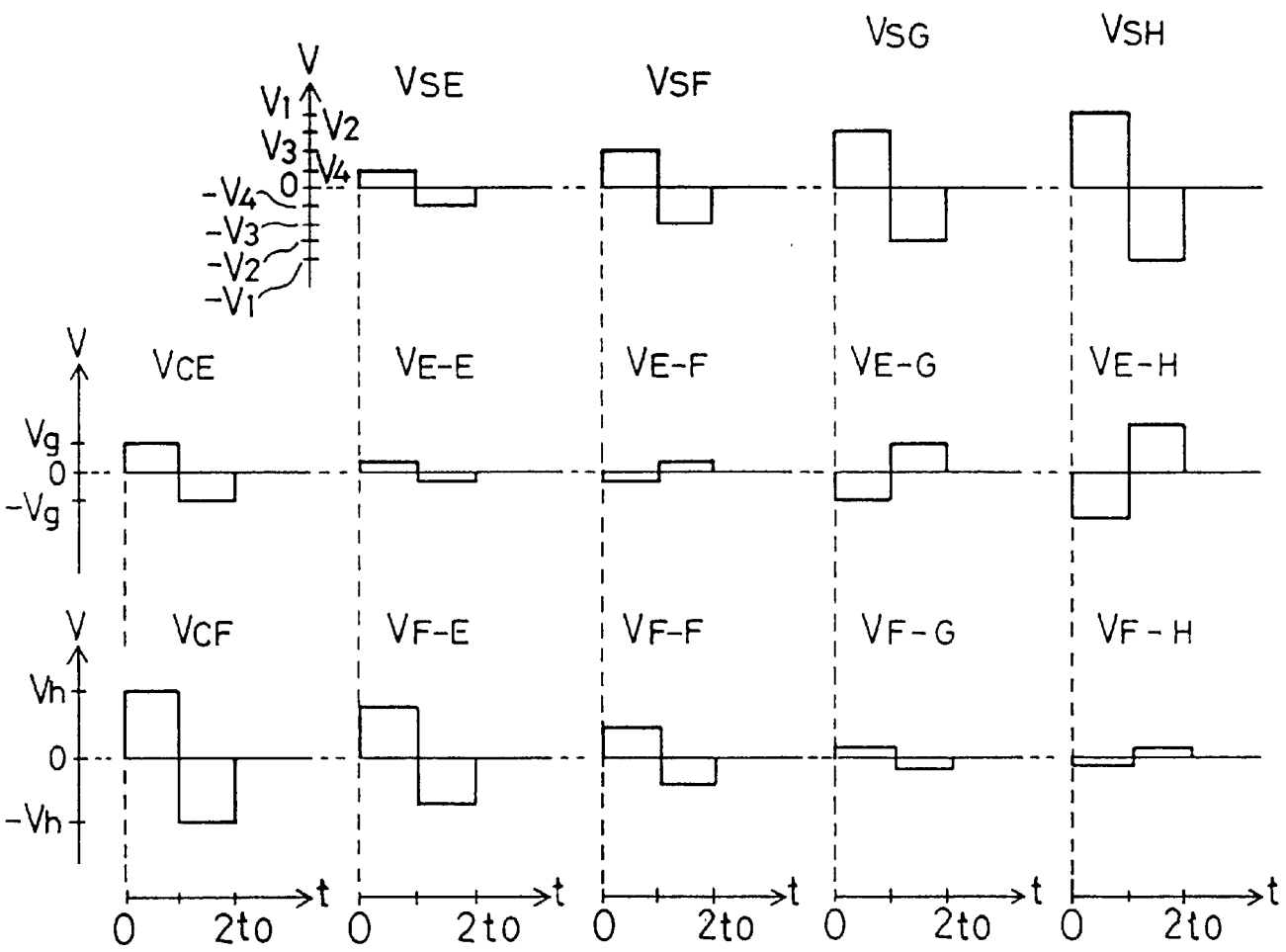
FIG. 14 is a waveform illustration showing the waveforms of drive voltages applied to the scanning electrodes and the segmented electrodes of the ferroelectric liquid crystal display apparatus of FIG. 11 in the non-selecting period.

This embodiment is characterized by alternately applying voltages waveforms $V_{CE}$ and $V_{CF}$ shown in FIG. 14 to the scanning electrodes L that are not selected. In this characteristic, it is possible to reduce the variation in the root-mean-square value of the bias voltage and improve the contrast. The pulse heights $V_g$ and $V_h$ of the voltage waveforms $V_{CE}$ and $V_{CF}$ satisfy the condition $$V_g<(V_{max}+V_{min})/2<V_h$$

where $V_{max}$ is a maximum of the pulse heights $V_1$ to $V_4$ of the signal voltages applied to the segmented electrodes S, and $V_{min}$ is a minimum thereof.

For example, when the pulse heights $V_4$, $V_3$, $V_2$ and $V_1$ of the voltage waveforms $V_{SE}$, $V_{SF}$, $V_{SG}$ and $V_{SH}$ are $2V_0$, $4V_0$, $6V_0$ and $8V_0$, respectively, $V_{max}$ is $8V_0$ and $V_{min}$ is $2V_0$. Therefore, for example, it is possible to make $V_g=3V_0$ and $V_h=7V_0$.

In this case, when the voltage waveforms $V_{SE}$ and $V_{SH}$ are applied to the segmented electrode in the non-selecting period, the average root-mean-square value of the bias voltage is given by $$(((V_0)^2+(5V_0)^2)/2)^{1/2}\approx 3.6V_0$$

When the voltage waveforms $V_{SF}$ and $V_{SG}$ are applied to the segmented electrode in the non-selecting period, the average root-mean-square value of the bias voltage is given by $$(((V_0)^2+(3V_0)^2)/2)^{1/2}\approx 2.2V_0$$

The ratio of these average root-mean-square values is given by $$3.6V_0/2.2V_0\approx 1.6$$

In a drive scheme disclosed in Japanese Publication for Unexamined Patent Application (Tokukaihei) No. 8-50278 (1996), for example, a bipolar pulse (shown in FIG. 23) of pulse height $V_k$ $$V_k=(V_2+V_3)/2$$

is applied to the scanning electrodes L in the non-selecting period. In this case, $V_k=5V_0$, and the average root-mean-square value of the bias voltage is $3V_0$ when the voltage waveforms $V_{SE}$ and $V_{SH}$ are applied to the segmented electrodes S. On the other hand, the average root-mean-square value of the bias voltage is $V_0$ when the voltage waveforms $V_{SF}$ and $V_{SG}$ are applied to the segmented electrodes S. The ratio of these average values is given by $$3V_0/V_0=3.0$$

Namely, it was found that the ferroelectric liquid crystal display apparatus of this embodiment achieves a smaller variation in the root-mean-square value of the bias voltage compared to a conventional structure. In general, as the difference between the pulse heights $V_g$, $V_h$ and the average pulse height of the signal voltage applied to the segmented electrodes S is increased, the variation in the root-mean-square value of the bias voltage is reduced.

Figure 15:
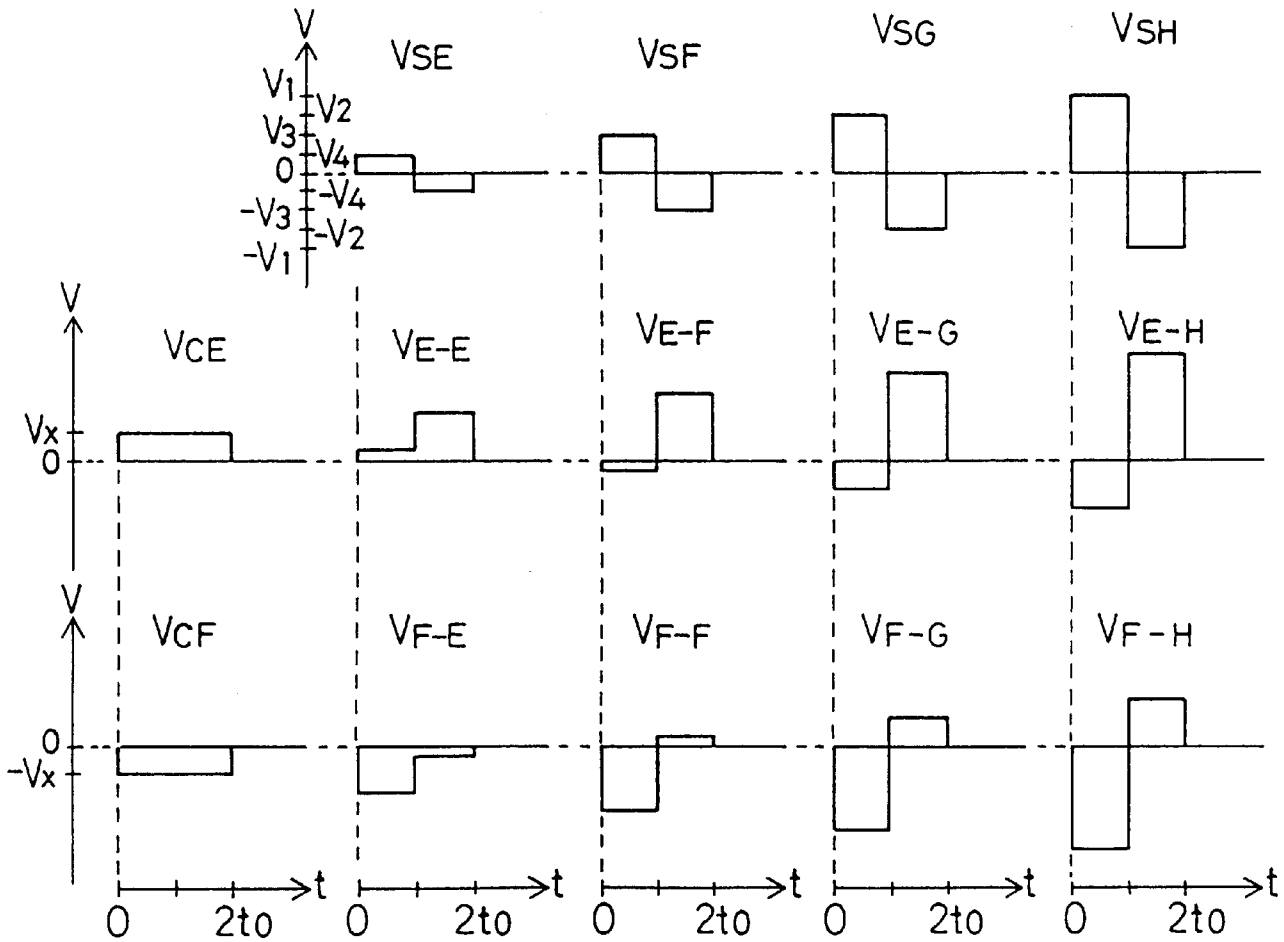
FIG. 15 is a waveform illustration showing another example of the waveforms of drive voltages applied to the scanning electrodes and the segmented electrodes of the ferroelectric liquid crystal display apparatus of FIG. 11 in the non-selecting period.

It has been explained with reference to FIG. 14 that two kinds of pulses $V_{CE}$ and $V_{CF}$ are alternately applied to the scanning electrodes L in the non-selecting period. However, it is also possible to use the voltage waveform $V_{CE}$ of two slots formed by two pulses of the same polarity and pulse height and the voltage waveform $V_{CF}$ of the same pulse height and the opposite polarity to the voltage waveform $V_{CE}$ as shown in FIG. 15. In this case, the voltage waveforms $V_{CE}$ and $V_{CF}$ are alternately applied at an interval of n selecting period (n is an integer not smaller than 1). The pulse height $V_X$ of the voltage waveforms $V_{CE}$ and $V_{CF}$ switches to $V_g$ or $V_h$ every two selecting periods. As a result, the same effects as those mentioned above can be produced.

As described above, in this embodiment, displays in four levels of gray scale are achieved by forming one pixel from three lines of scanning electrodes and one line of segmented electrode, simultaneously applying scanning voltages of different selection voltage waveforms to the three lines of scanning electrodes, and applying any one of four kinds of signal voltages to the segmented electrode. Moreover, by adjusting the pulse height of the voltage waveform to be applied to the scanning electrode in the non-selecting period, the variation in the root-mean-square value of the bias voltage is reduced compared to the conventional structure. As a result, a ferroelectric liquid crystal display apparatus with gray scale display capabilities and high contrast is achieved.

Embodiment 3

The following description will discuss still another embodiment of the present invention with reference to FIGS. 2, 3, 16 to 18.

A ferroelectric liquid crystal display apparatus of this embodiment is characterized by including the liquid crystal panel 1 shown in FIG. 2 and temperature measuring means, not shown, for measuring the temperature of the FLC 8. This ferroelectric liquid crystal display apparatus is also characterized in compensating a change of the memory angle of the FLC 8 caused by a change in temperature by superimposing a DC voltage on a drive voltage to be applied to the scanning electrodes L, based on the temperature change from a predetermined reference temperature.

Figure 16:
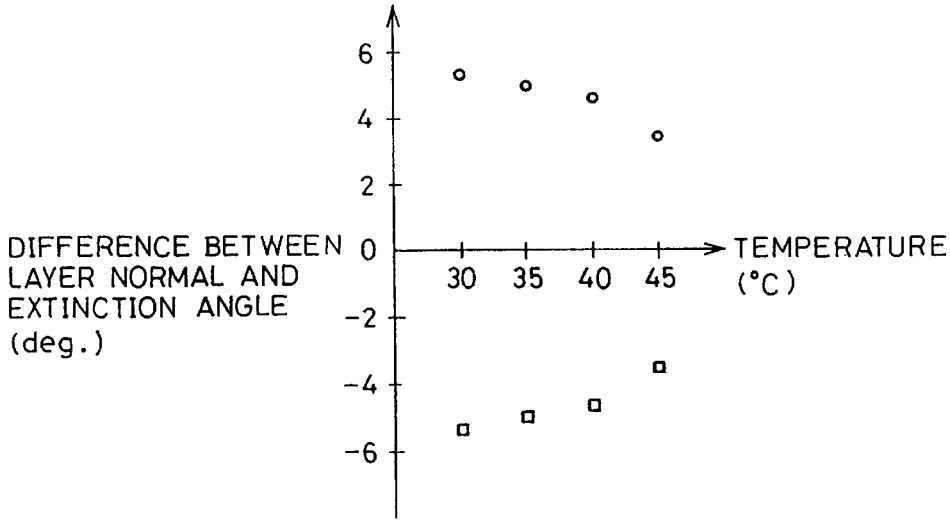
FIG. 16 is a graph showing the temperature dependence of the memory angle.

First, the relationship between the change in temperature and the memory angle of molecules of the FLC 8 will be explained. As discussed in Embodiment 1, the ferroelectric liquid crystal molecule 51 constituting the FLC 8 has two stable states, positions $P_1$ and $P_2$, as shown in FIG. 3 (*a*). An angle formed by the molecule long axis of the liquid crystal molecule 51 in the position $P_1$ and a center axis 52 is called a memory angle $\theta_m$ as shown in FIG. 3(*a*). As illustrated in FIG. 16, the memory angle $\theta_m$ changes depending on the temperature of the FLC 8. For example, it can be seen that the memory angle is around ±5° at 30° C., decreases with a rise in temperature, and becomes around ±3° at 45° C.

It was found that, after switching the liquid crystal molecule 51 to the first or second stable state by applying a switching voltage thereto, if a DC voltage is further applied, the liquid crystal molecule 51 shifts from the stable state, i.e., position $P_1$ or $P_2$, according to the voltage applied.

Figure 17:
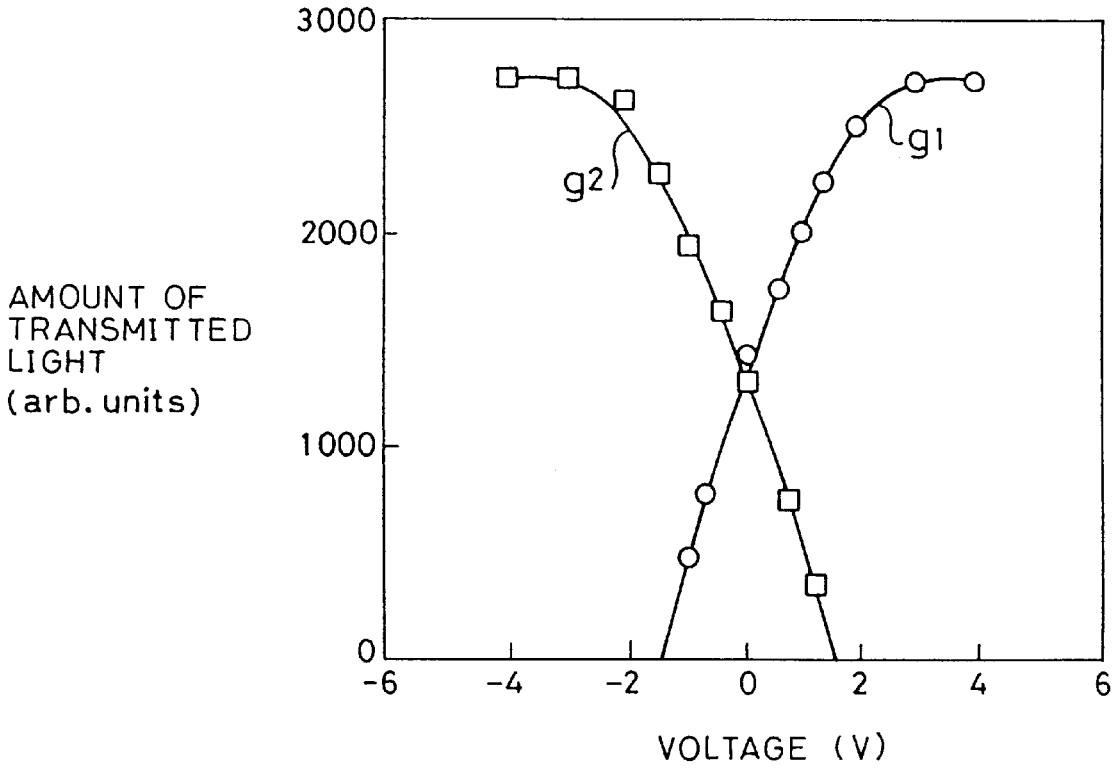
FIG. 17 is a graph showing changes in the amount of transmitted light when a voltage was further applied after the liquid crystal molecules were brought into the first or second stable state.

Like Japanese Publication for Unexamined Patent Application (Tokukaihei) No. 7-120722 (1995), the liquid crystal molecule 51 is switched to the second stable state by aligning the polarization axis of the polarizing plate with the center axis 52 shown in FIG. 3(*a*) and applying a positive switching voltage. In this condition, a voltage is further applied, and $g_1$ in FIG. 17 shows the amount of transmitted light against the voltage. Similarly, the liquid crystal molecule 51 is switched to the first stable state by applying a negative switching voltage. In this condition, a voltage is further applied, and $g_2$ in FIG. 17 shows the amount of transmitted light against the voltage. When the molecule long axis of the liquid crystal molecule 51 is aligned with the center axis 52, i.e., the polarization axis of the polarizing plate, the amount of transmitted light is zero. The amount of transmitted light increases as the molecule long axis of the liquid crystal molecule 51 approaches a tilted axis 53 or 54.

It can be seen from FIG. 17 that when a positive voltage is further applied to the ferroelectric liquid crystal molecule 51 which has been switched to the second memory state with the application of a positive switching voltage, the ferroelectric liquid crystal molecule 51 further moves from the position $P_2$ toward the tilted angle 54. It can be also known that when a negative voltage is further applied to the ferroelectric liquid crystal molecule 51 which has been switched to the first memory state with the application of a negative switching voltage, the ferroelectric liquid crystal molecule 51 further moves from the position $P_1$ toward the tilted angle 53.

With the use of such phenomena, it is possible to compensate a change of the memory angle $\theta_m$ resulting from a change in temperature. More specifically, the drive voltage applied to the scanning electrodes L at a temperature $T_0$ has, for example, a waveform shown at the top in FIG. 18. This waveform is the same as the waveform of the drive voltage of the scanning electrode according to the J/A drive scheme explained in Embodiment 1. Namely, the selecting period is formed by two slots (0 to $2t_0$), and a strobe pulse with a pulse height of $2V_0$ is applied in the second slot of the selecting period. In addition, a blanking pulse of the opposite polarity to the strobe pulse and a pulse height of $V_0$ is applied twice before the selecting period.

Furthermore, the polarization axis of the polarizing plate 10 is positioned according to the memory angle $\theta_{m0}$ of the liquid crystal molecule 51 at temperature $T_0$. More specifically, the polarizing plate 10 is positioned so that the polarization axis is aligned with the molecule long axis when the liquid crystal molecule 51 is in one of the stable states at temperature $T_0$.

When the temperature becomes higher than $T_0$, the memory angle $\theta_m$ of the liquid crystal molecule 51 becomes smaller than $\theta_{m0}$. At this time, as shown by the middle waveform in FIG. 18, a negative voltage having pulse height $V_m$ corresponding to the rise of temperature from $T_0$ is superimposed from the selecting period to the blanking period. In this case, the pulse heights of the strobe pulse and blanking pulse do not vary.

Additionally, a positive voltage having a pulse height $V_P$ for cancelling the DC component of the superimposed negative voltage is applied after the blanking pulse. Since the dielectric anisotropy of the ferroelectric liquid crystals used in this embodiment is negative, the positive voltage $V_P$ satisfy the condition $$V_P > 2V_0$$

and a blanking voltage $-V_0$ is applied just before the application of the positive voltage $V_P$, the liquid crystal molecule 51 is not switched to the other stable state by the positive voltage $V_P$.

By applying the negative voltage $V_m$ in such a manner, the change of the memory angle caused by a rise in temperature is compensated, and the long axis of the liquid crystal molecules in one of the stable states and the polarization axis of the polarizing plate 10 are kept in alignment.

Figure 18:
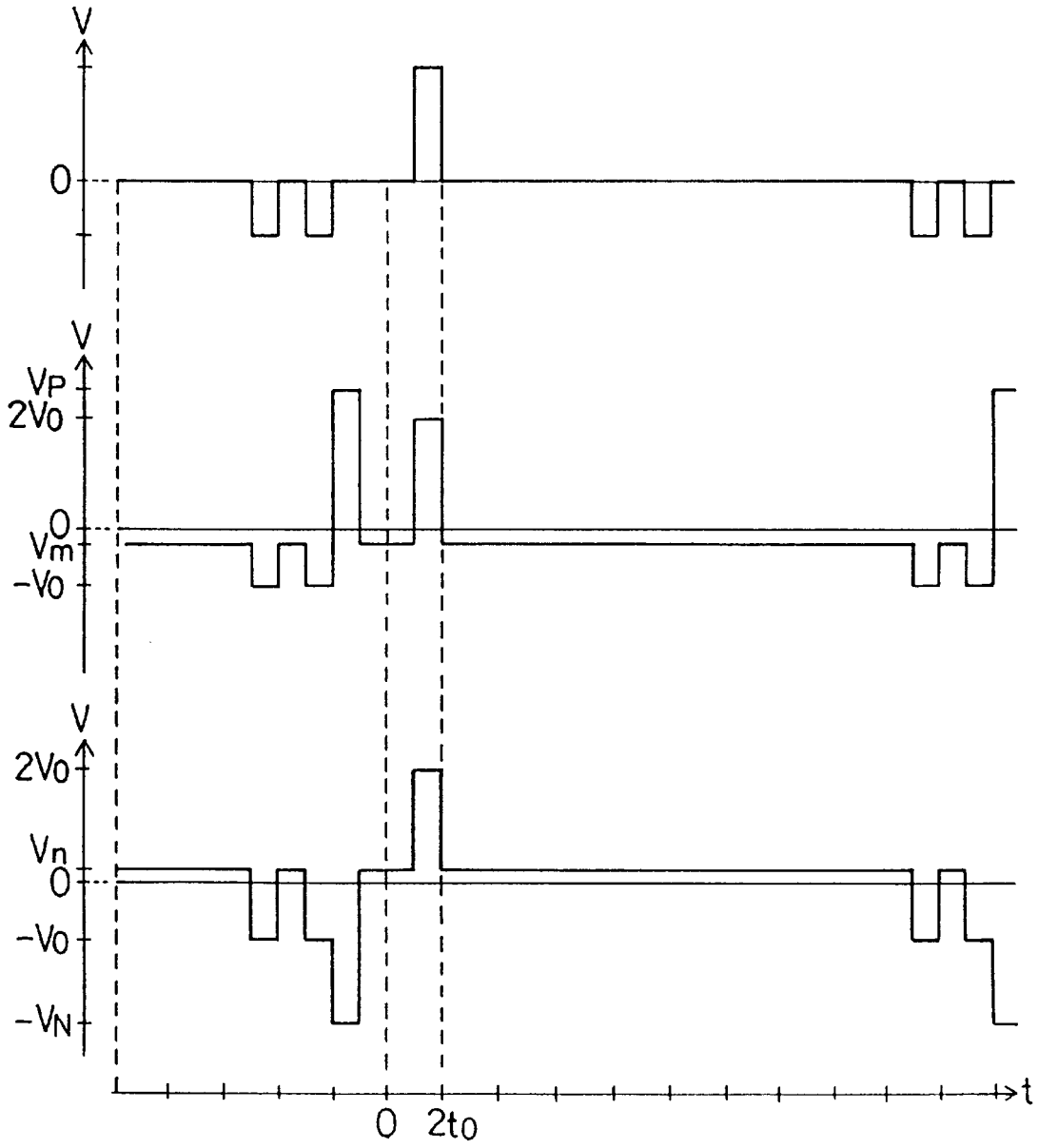
FIG. 18 is a waveform illustration showing the waveforms of drive voltages applied to the scanning electrodes in a ferroelectric liquid crystal display apparatus according to still another embodiment of the present invention.

On the other hand, when the temperature becomes lower than $T_0$, as shown by the bottom waveform in FIG. 18, a positive voltage having a pulse height $V_n$ corresponding to the lowering of temperature from $T_0$ is superimposed from the selecting period to the blanking period. In this case, the pulse heights of the strobe pulse and blanking pulse do not vary. In addition, a negative voltage having a pulse height $V_N$ for cancelling the DC component of the superimposed positive voltage is applied after the blanking pulse. Even when the negative voltage is provided to switch the liquid crystal molecule 51 to the other stable state, the display of pixel is not affected because the liquid crystal molecule 51 has been switched to the other stable state by the blanking pulse applied just before the application of the negative voltage $V_N$.

Consequently, like the case of the temperature rise, the change of the memory angle caused by the lowering of temperature is compensated, and the long axis of the liquid crystal molecules in one of the stable states and the polarization axis of the polarizing plate 10 are kept in alignment.

In the above-mentioned explanation, for example, the molecule long axis of the liquid crystal molecule 51 in one of the stable states and the polarization axis of the polarizing plate 10 are aligned. However, needless to say, the molecule long axis and the polarization axis of the polarizing plate 11 may be aligned with each other.

As described above, in this embodiment, the change of the memory angle depending on a change in temperature can be compensated by a drive voltage applied to the scanning electrodes L. Consequently, it is possible to achieve a ferroelectric liquid crystal display apparatus capable of retaining good contrast even if the temperature of the FLC 8 varies due to a change in ambient temperature and heat generated by itself when driven.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A passive-matrix type liquid crystal display apparatus having a pixel formed by a liquid crystal lying at each intersection of scanning electrodes and segmented electrodes, characterized in that:

said liquid crystal is a ferroelectric liquid crystal; and a DC voltage varying according to a measured change in temperature of said liquid crystal is superimposed over a drive voltage applied to said scanning electrodes, wherein a blanking voltage is applied to said scanning electrodes before a selecting period, and a voltage for cancelling a superimposed DC component is applied to said scanning electrodes after said blanking voltage and before said selecting period.

2. The passive-matrix type liquid crystal display apparatus according to claim 1, wherein said ferroelectric liquid crystal has negative dielectric anisotropy.

* * * * *